US010220427B2

(12) United States Patent
Yoshikawa et al.

(10) Patent No.: US 10,220,427 B2
(45) Date of Patent: Mar. 5, 2019

(54) PRESS-MOLDING APPARATUS, PRESS-MOLDING METHOD, AND PRESS-MOLDED PRODUCT

(71) Applicant: NIPPON STEEL & SUMITOMO METAL CORPORATION, Tokyo (JP)

(72) Inventors: Nobuo Yoshikawa, Tokyo (JP); Hiroshi Yoshida, Tokyo (JP); Jun Nitta, Tokyo (JP); Tohru Yoshida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 159 days.

(21) Appl. No.: 15/034,902

(22) PCT Filed: Dec. 5, 2014

(86) PCT No.: PCT/JP2014/082188

§ 371 (c)(1),
(2) Date: May 6, 2016

(87) PCT Pub. No.: WO2015/083812

PCT Pub. Date: Jun. 11, 2015

(65) Prior Publication Data

US 2016/0263637 A1 Sep. 15, 2016

(30) Foreign Application Priority Data

Dec. 6, 2013 (JP) ..... 2013-253463
Dec. 6, 2013 (JP) ..... 2013-253465

(51) Int. Cl.
*B21D 22/26* (2006.01)
*B21D 22/02* (2006.01)
(Continued)

(52) U.S. Cl.
CPC ..... *B21D 22/02* (2013.01); *B21D 22/26* (2013.01); *B21J 5/025* (2013.01); *B21J 13/025* (2013.01)

(58) Field of Classification Search
CPC ..... B21D 22/02; B21D 22/21; B21D 22/24; B21D 22/26; B21D 22/30; B21J 5/025; B21J 13/025
See application file for complete search history.

(56) References Cited

U.S. PATENT DOCUMENTS 6,701,603 B2 * 3/2004 Matsuura ..... H02K 1/17 29/421.1
7,171,838 B2 * 2/2007 Shiokawa ..... B21D 22/02 72/347
(Continued)

FOREIGN PATENT DOCUMENTS

CN 1706572 A 12/2005
CN 101323002 A 12/2008
(Continued)

OTHER PUBLICATIONS

Japanese Office Action, dated Oct. 4, 2016, for Japanese Application No. 2015-551570, along with a partial English translation.
(Continued)

*Primary Examiner* — Edward Tolan
(74) *Attorney, Agent, or Firm* — Birch, Stewart, Kolasch & Birch, LLP

(57) ABSTRACT

[Object] To provide a press-molding apparatus capable of appropriately thickening a vertical wall portion while preventing the occurrence of buckling.
[Solution] Provided is a press-molding apparatus configured to mold a press-molded product by performing press working on a work, the press-molding apparatus including: a support member that supports the work with a first thickness having a hat-shaped cross-section or a U-shaped cross-
(Continued)

section; a punch member that moves relative to the support member to execute press working so as to reduce a height of a vertical wall portion of the work and thicken the vertical wall portion to a second thickness; and a pad member that faces the support member with the vertical wall portion to be thickened placed therebetween, the pad member being biased by a biasing member and having its distance to the support member kept equal to or smaller than the second thickness during the press working.

16 Claims, 37 Drawing Sheets

(51) Int. Cl.
*B21J 5/02* (2006.01)
*B21J 13/02* (2006.01)

(56) References Cited

U.S. PATENT DOCUMENTS

| | | | | |
|---|---|---|---|---|
| 7,624,611 | B2 * | 12/2009 | Saitou | B21D 22/20 72/348 |
| 2006/0236741 | A1 * | 10/2006 | Saitou | B21D 22/06 72/348 |
| 2008/0299352 | A1 | 12/2008 | Matsuda et al. | |
| 2013/0040161 | A1 * | 2/2013 | Gerlach | B21J 5/08 428/603 |

FOREIGN PATENT DOCUMENTS

| | | | |
|---|---|---|---|
| JP | 11-90550 | A | 4/1999 |
| JP | 2001-47175 | A | 2/2001 |
| JP | 2008-296252 | A | 12/2008 |
| JP | 2009-248092 | A | 10/2009 |
| JP | 2010-149179 | A | 7/2010 |

OTHER PUBLICATIONS

International Search Report for PCT/JP2014/082188 dated Jan. 13, 2015.
Written Opinion of the International Searching Authority for PCT/JP2014/082188 (PCT/ISA/237) dated Jan. 13, 2015.
Korean Office Action, dated Sep. 25, 2017, for corresponding Korean Application No. 10-2016-7014610, with a partial English translation thereof.
Chinese Office Action and Search Report, dated Dec. 14, 2016, for Chinese Application No. 201480065376.9, with an English translation of the Chinese Office Action.
Japanese Office Action, dated Feb. 28, 2017, for corresponding Japanese Application No. 2015-551570, with a partial English translation.
Korean Office Action, dated Mar. 23, 2017, for corresponding Korean Application No. 10-2016-7014610, with a partial English translation thereof.
Japanese Office Action dated Apr. 10, 2018 for corresponding Japanese Application No. 2017-105362, with partial English translation.

* cited by examiner

PRESS-MOLDING APPARATUS, PRESS-MOLDING METHOD, AND PRESS-MOLDED PRODUCT

TECHNICAL FIELD

The present invention relates to a press-molding apparatus, a press-molding method, and a press-molded product.

BACKGROUND ART

A press-molding apparatus that molds a press-molded product having a hat-shaped cross-section or a U-shaped cross-section by subjecting a work to press working has been used. The molded press-molded product is, for example, used as a part of a vehicle, such as a car.

In view of securing collision safety, body rigidity, and the like, a press-molded product used as a part of a vehicle is required to partly have increased strength. Hence, there is used a technique of, in press-molding a press-molded product from a work having a hat-shaped cross-section, causing a material of the work to flow so as to thicken part of the work as in Patent Literature 1 below. Specifically, a vertical wall portion of the work is reduced in height and thickened.

CITATION LIST

Patent Literature(s)

[Patent Literature 1] JP 2008-296252A

SUMMARY OF INVENTION

Technical Problem

In the case of performing press molding so as to reduce the height of the vertical wall portion, buckling tends to occur in the vertical wall portion. The occurrence of buckling makes it difficult to mold a vertical wall portion that is thickened into an appropriate shape. Note that Patent Literature 1 described above does not include sufficient discussion on the buckling of the vertical wall portion at the time of press molding.

Hence, the present invention has been made in view of the above problem, and an object of the present invention is to provide a press-molding apparatus capable of appropriately thickening a vertical wall portion while preventing the occurrence of buckling.

Solution to Problem

In order to solve the above problem, according to an aspect of the present invention, there is provided a press-molding apparatus configured to mold a press-molded product by performing press working on a work, the work having a hat-shaped cross-section or a U-shaped cross-section including an upper wall portion and a vertical wall portion with a first thickness, the press-molding apparatus including: a first support member that supports the work from the inside of the hat-shaped cross-section or the U-shaped cross-section; a second support member that supports the work at a lower end portion of the vertical wall portion; a punch member that moves downward relative to the second support member, together with the first support member, to execute press working of reducing a height of the vertical wall portion and thickening the vertical wall portion to a second thickness larger than the first thickness; a pad member that faces the first support member with the vertical wall portion placed between the pad member and the first support member; and a position adjustment mechanism that adjusts a position of the pad member in a manner that contact between the pad member and the vertical wall portion is maintained during the press working.

In the above press-molding apparatus, the position adjustment mechanism may include a biasing member that biases the pad member toward the vertical wall portion.

In the above press-molding apparatus, the position adjustment mechanism may include a distance adjustment mechanism that enlarges a distance between the first support member and the pad member concurrently with downward movement of the punch member during the press working.

In the above press-molding apparatus, the distance adjustment mechanism may include an inclined surface that is formed on the pad member and is higher at positions farther from the first support member, and a pressing portion that is formed in the punch member and presses the inclined surface to cause the pad member to move in a direction going away from the first support member during the press working.

In the above press-molding apparatus, the work may have the hat-shaped cross-section or the U-shaped cross-section opening toward a lower end of the vertical wall portion. The first support member may have a first inclined surface that faces the vertical wall portion. The pad member may have a second inclined surface that faces the first inclined surface with the vertical wall portion placed between the second inclined surface and the first inclined surface. The distance adjustment mechanism may include a driving mechanism that causes the second inclined surface to proceed toward the vertical wall portion to follow the first inclined surface that recedes from the vertical wall portion owing to downward movement of the first support member during the press working.

In the above press-molding apparatus, additional press working of bending a flat plate to mold the work having the hat-shaped cross-section or the U-shaped cross-section may be performed. In the additional press working, in a state where a portion of the flat plate that constitutes the upper wall portion after processing is sandwiched by the first support member and the punch member, the pad member abutting on the flat plate may move downward relative to the first support member, the second support member, and the punch member to bend a portion of the flat plate that constitutes the vertical wall portion after processing, and cause a lower end portion of the portion to abut against the second support member.

In the above press-molding apparatus, the work may have a corner portion connected to the vertical wall portion. The punch member may perform press working so as to reduce a height of the vertical wall portion and thicken the vertical wall portion and the corner portion.

In the above press-molding apparatus, the work may be a long member. The punch member may reduce a height of the vertical wall portion in the entire longitudinal direction and thicken the entire vertical wall portion to the second thickness.

In order to solve the above problem, according to an aspect of the present invention, there is provided a press-molding method configured to mold a press-molded product by performing press working on a work, the work having a hat-shaped cross-section or a U-shaped cross-section including an upper wall portion and a vertical wall portion with a first thickness, the press-molding method including: a step of causing a first support member to support the work from the inside of the hat-shaped cross-section or the U-shaped cross-section; a step of causing a second support member to support the work at a lower end portion of the vertical wall portion; a step of causing a punch member to move downward relative to the second support member, together with the first support member, to execute press working of reducing a height of the vertical wall portion placed between the first support member and a pad member and thickening the vertical wall portion to a second thickness larger than the first thickness; and a step of adjusting a position of the pad member, by a position adjustment mechanism, in a manner that the pad member that faces the first support member with the vertical wall portion placed between the pad member and the first support member maintains contact with the vertical wall portion during the press working.

In order to solve the above problem, according to an aspect of the present invention, there is provided a press-molded product having a hat-shaped cross-section or a U-shaped cross-section that is molded by performing press working on a work with a first thickness, the press-molded product including: an upper wall portion with the first thickness; and thickened vertical wall portions that are connected to both end portions of the upper wall portion and have a second thickness larger than the first thickness.

Advantageous Effects of Invention

As described above, the present invention makes it possible to appropriately thicken a vertical wall portion while preventing the occurrence of buckling.

BRIEF DESCRIPTION OF THE DRAWING(S)

DESCRIPTION OF EMBODIMENTS

Hereinafter, (a) preferred embodiment(s) of the present invention will be described in detail with reference to the appended drawings. In this specification and the drawings, elements that have substantially the same function and structure are denoted with the same reference signs, and repeated explanation is omitted.

1. First Embodiment

1-1. Overview of Press-Molded Product

Figure 1:
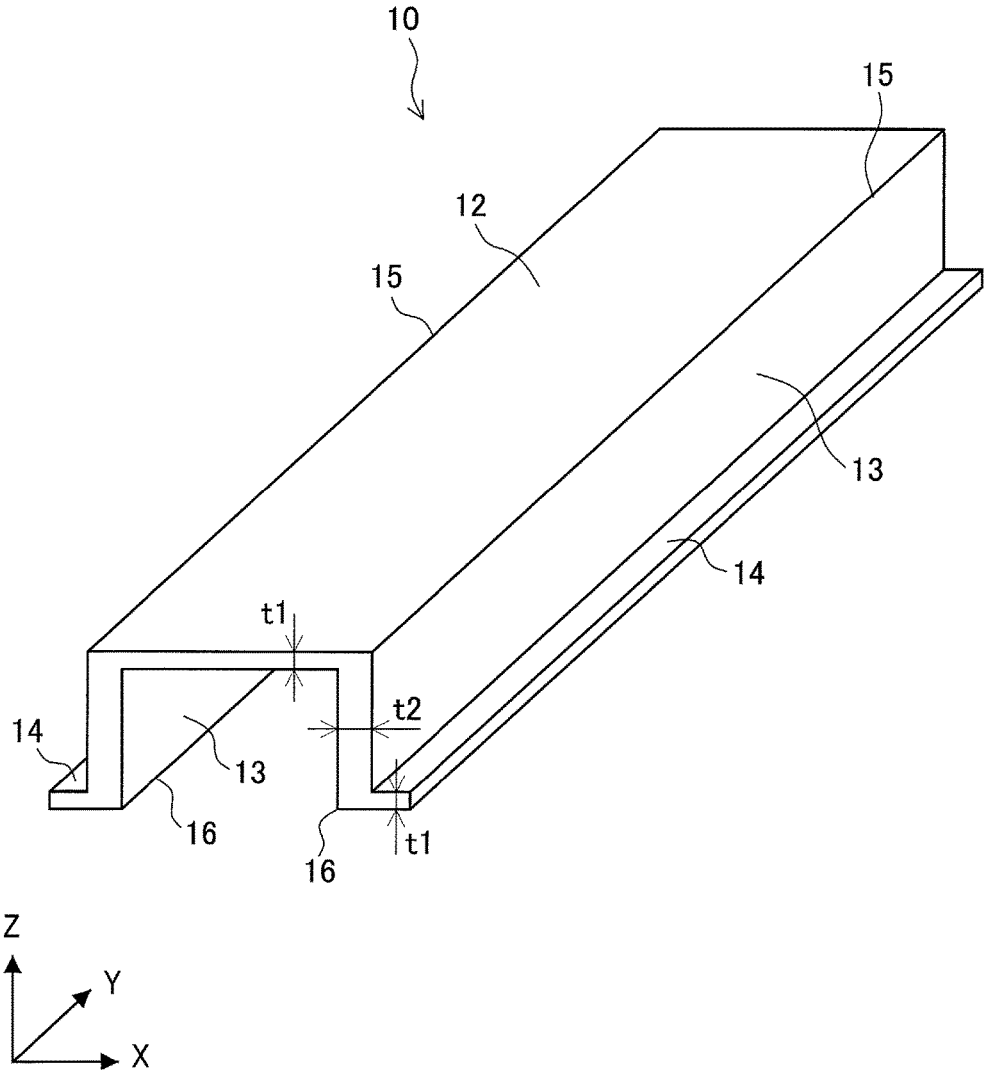
FIG. 1 is a perspective view of a configuration example of a press-molded product according to a first embodiment of the present invention.

A configuration example of a press-molded product 10 according to a first embodiment of the present invention will be described referring to FIG. 1. FIG. 1 is a perspective view of the configuration example of the press-molded product 10 according to the first embodiment.

The press-molded product 10 can be used as a part of any of various devices, but is described here as one that is used as a part of a vehicle, such as a car. For example, the press-molded product 10 is used as a center pillar of a car, which is required of high rigidity. In such a case, to secure safety against an impact on a side surface of the center pillar, for example, there is a need to increase the rigidity and strength of an area of the press-molded product 10 to which the impact is applied.

The press-molded product 10 is molded by subjecting a flat plate (also called a blank) to processing, such as bending and drawing, by a press-molding apparatus. In the first embodiment, the press-molded product 10 is a long molded product extending with a so-called hat-shaped cross-section as illustrated in FIG. 1. Specifically, the press-molded product 10 includes an upper wall portion 12, thickened vertical wall portions 13, and flange portions 14.

Figure 2:
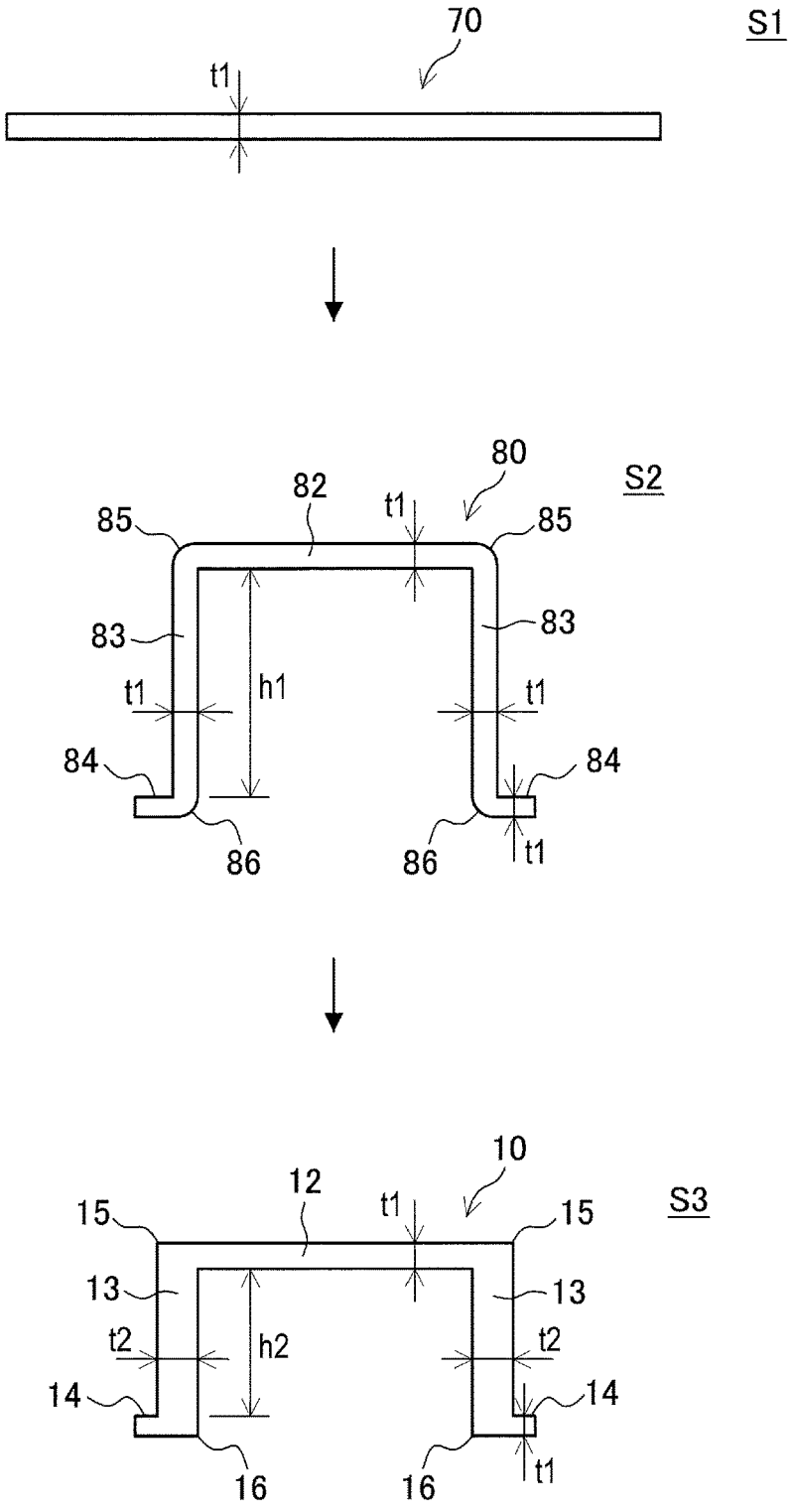
FIG. 2 is a schematic view of an example of a manufacturing process of the press-molded product according to the first embodiment.

The upper wall portion 12 is molded into a thickness t1 (e.g., 1.6 mm) that is the same as the plate thickness of the blank (refer to a blank 70 illustrated in FIG. 2). The upper wall portion 12 is a rectangular surface that is flat along the longitudinal direction of the press-molded product 10 (Y direction of FIG. 1).

The vertical wall portions 13 are a pair of wall portions formed substantially perpendicular to the upper wall portion 12. The vertical wall portions 13 are connected to both end portions of the upper wall portion 12 in the width direction (X direction of FIG. 1). A thickness t2 (e.g., 2.0 mm) of the vertical wall portion 13 is increased by the press-molding apparatus described later to be larger than the thickness t1 of the upper wall portion 12. This increases the rigidity and strength of the vertical wall portion 13 in the press-molded product 10. In addition, the vertical wall portion 13 is hardened owing to strain (work hardening) at the time of thickening by the press-molding apparatus to have further increased rigidity and strength. Note that the thickness t1 corresponds to a first thickness, and the thickness t2 corresponds to a second thickness.

The flange portion 14 is connected to a lower end portion of the vertical wall portion 13. The flange portion 14 is molded into the thickness t1, which is the same as that of the upper wall portion 12. The flange portion 14 is provided with, for example, a fastening hole (not illustrated) for fastening the press-molded product 10 to the vehicle main body.

Note that in the press-molded product 10, a corner portion 15 between the upper wall portion 12 and the vertical wall portion 13, and a corner portion 16 of the vertical wall portion 13 and the flange portion 14 are also thickened as illustrated in FIG. 1. Specifically, the corner portions 15 and 16 are thickened to be flush with the vertical wall portion 13 in the width direction of the press-molded product 10 (X direction of FIG. 1). Thus, the corner portions 15 and 16 also have increased rigidity.

Next, an example of a manufacturing method of the press-molded product 10 with the above-described configuration will be described referring to FIG. 2. The press-molded product 10 is molded by performing press working twice on the blank 70.

FIG. 2 is a schematic view of an example of a manufacturing process of the press-molded product 10 according to the first embodiment. The manufacturing process of the press-molded product 10 illustrated in FIG. 2 starts from preparing the blank 70 as a preparation step S1. Here, the blank 70 is a flat plate with the plate thickness t1.

Next, in a first molding step S2, the first press working is performed on the blank 70. The first press working is bending and drawing, for example, by a press-molding apparatus including a die and a punch. A primary molded product 80 having been subjected to the first press working is a long molded product having a hat-shaped cross-section with the plate thickness t1. That is, the primary molded product 80 includes an upper wall portion 82 corresponding to the upper wall portion 12 of the press-molded product 10, vertical wall portions 83 corresponding to the vertical wall portions 13, and flange portions 84 corresponding to the flange portions 14. Here, the vertical wall portion 83 has a height h1. In addition, a corner portion 85 of the upper wall portion 82 and the vertical wall portion 83, and a corner portion 86 of the vertical wall portion 83 and the flange portion 84 each have a curved surface (so-called R surface).

Next, in a second molding step S3, the second press working is performed on the primary molded product 80 serving as a work. The second press working is performed by a press-molding apparatus 100 described later. By the second press working, the press-molded product 10 serving as a secondary molded product obtained by thickening the vertical wall portions 83 to the thickness t2 is molded.

Specifically, while the height of the vertical wall portion 83 of the primary molded product 80 is reduced from h1 to h2, the vertical wall portion 83 is thickened to the thickness t2. At this time, the corner portion 85 of the upper wall portion 82 and the vertical wall portion 83, and the corner portion 86 of the vertical wall portion 83 and the flange portion 84 are also thickened. As a result, the press-molded product 10 with the thickened vertical wall portions 13 and corner portions 15 and 16 is molded.

By the above-described manufacturing method of the press-molded product 10 according to the first embodiment, the press-molded product 10 having a hat-shaped cross-section in which the vertical wall portions 13 have been thickened to the plate thickness t2 can be molded by using the blank 70, which is a flat plate with the plate thickness t1.

A known manufacturing method in which a molded product is partly thickened is tailored blank. In tailored blank, two plates having different plate thicknesses are welded before press molding into one blank. The thicker plate of the two plates is applied to an area that needs rigidity and strength. In this tailored blank, however, a weld where the two plates have been welded is left in the molded product.

A tailored rolled blank is also known. The tailored rolled blank is a blank obtained by using a rolled coil (into which a steel plate is wound) that is partly made to have a different thickness in advance. Such a method, however, needs a custom-made coil.

Furthermore, there is known a method of providing a stiffening member called a stiffener in an area that needs rigidity and strength of a blank. In such a method, however, providing the stiffening member increases the number of parts.

In contrast, the manufacturing method of the press-molded product 10 according to the first embodiment does not make a weld, does not need to use a custom-made coil, and does not increase the number of parts. That is, the press-molded product 10 in which the vertical wall portions 13, to which an impact can be applied if the press-molded product 10 is used for a center pillar of a car, have been thickened beyond the plate thickness t1 of the blank 70 can be molded by an easy manufacturing method.

1-2. Configuration Example of Press-Molding Apparatus

A configuration example of the press-molding apparatus 100 according to the first embodiment will be described referring to FIGS. 3 to 5. The press-molding apparatus 100 performs press working of the primary molded product 80 serving as a work, thereby molding the press-molded product 10 serving as the secondary molded product in which the vertical wall portions 13 have been thickened.

Figure 3:
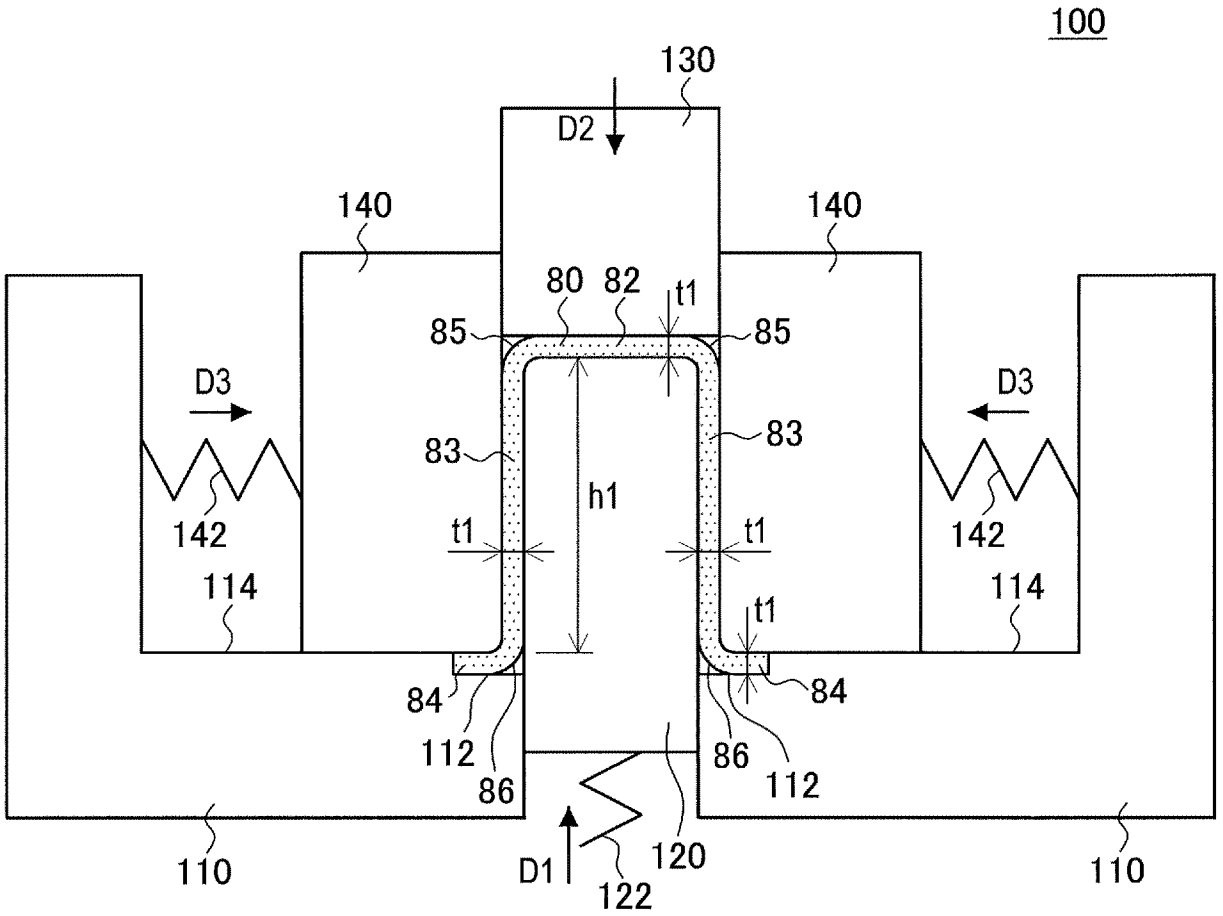
FIG. 3 is a schematic view for explaining a configuration example of a press-molding apparatus according to the first embodiment.
Figure 4:
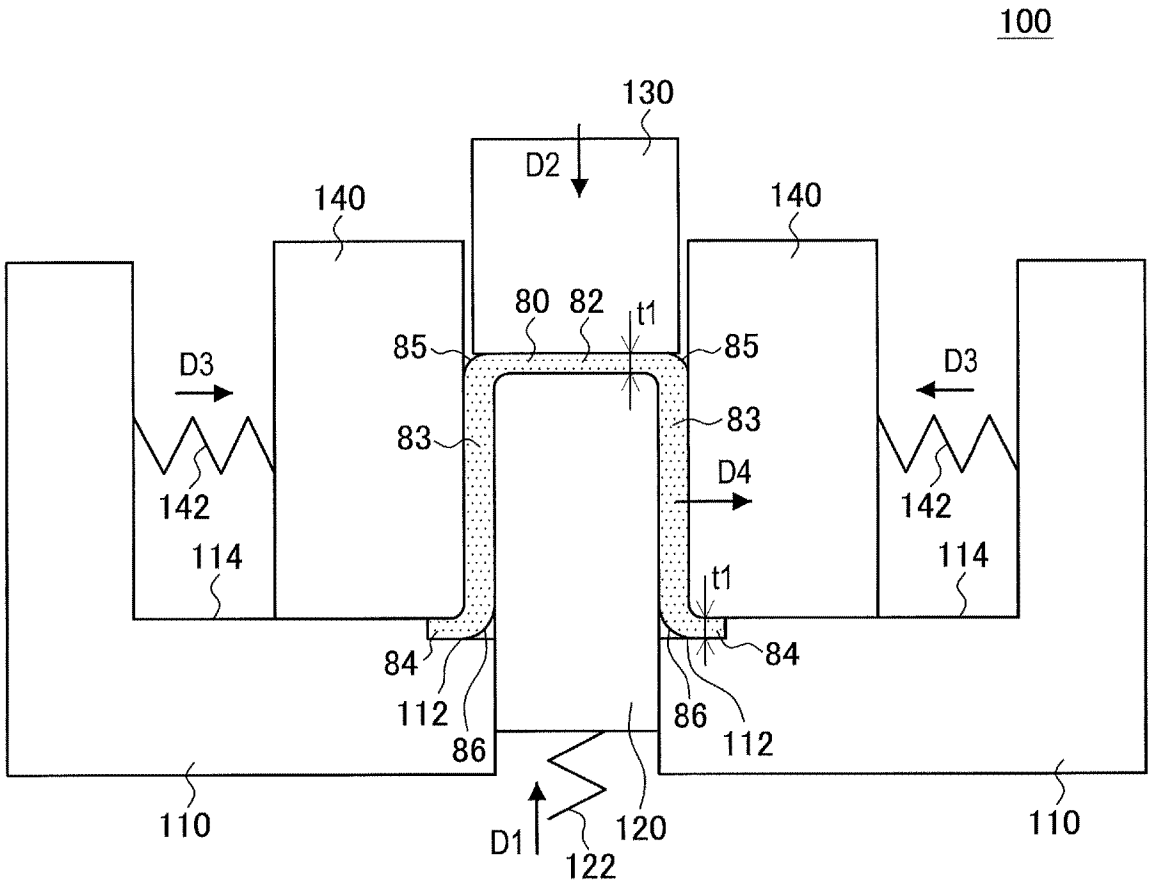
FIG. 4 is a schematic view for explaining the configuration example of the press-molding apparatus according to the first embodiment.
Figure 5:
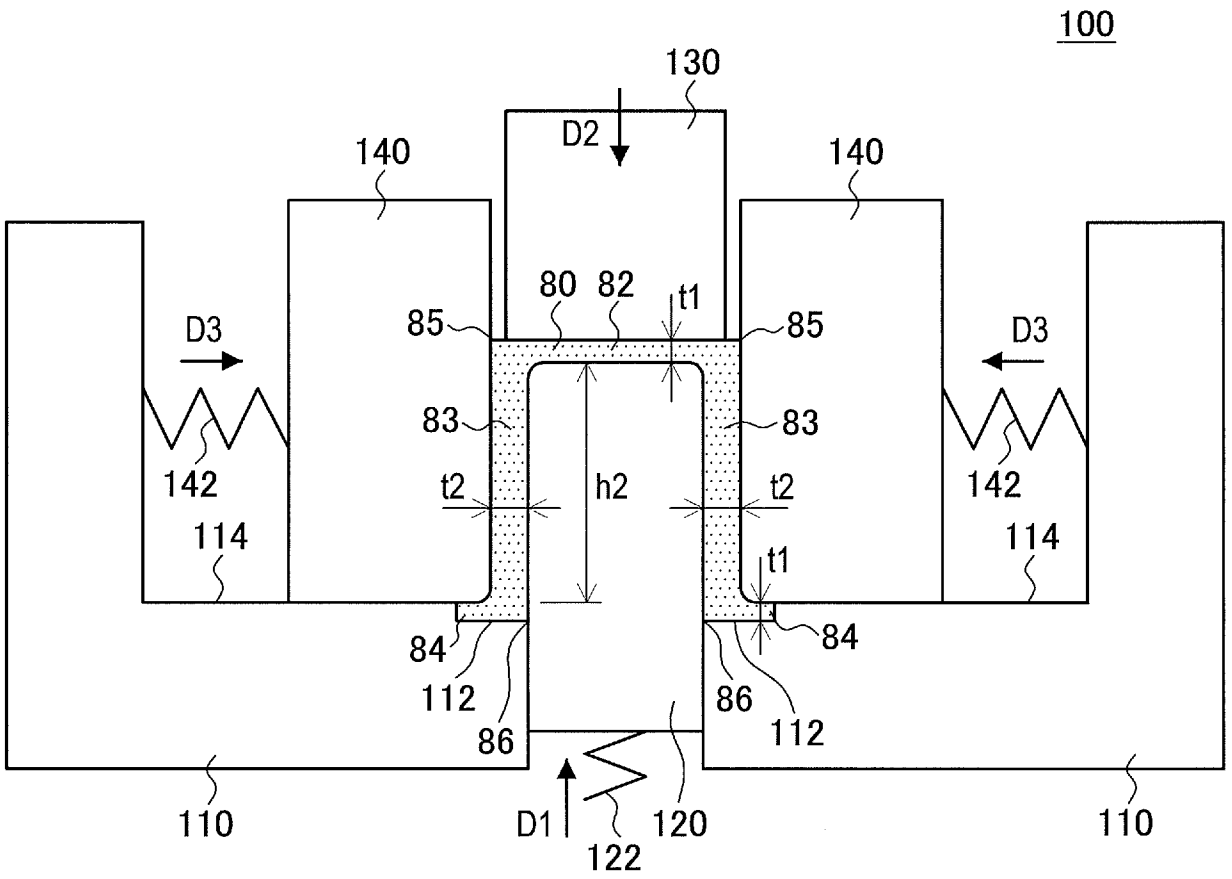
FIG. 5 is a schematic view for explaining the configuration example of the press-molding apparatus according to the first embodiment.

FIGS. 3 to 5 are schematic views for explaining the configuration example of the press-molding apparatus 100 according to the first embodiment. Note that FIG. 3 illustrates a state of the press-molding apparatus 100 just before starting press working for thickening, FIG. 4 illustrates a state of the press-molding apparatus 100 during the press working, and FIG. 5 illustrates a state of the press-molding apparatus 100 at the end of the press working (a punch is positioned at the bottom dead point).

The press-molding apparatus 100 includes, as illustrated in FIGS. 3 to 5, a die 110, a cushion 120, a punch 130, which is an example of a punch member, and pads 140, which are examples of pad members. Note that the die 110 and the cushion 120 are examples of support members that support the primary molded product 80. More specifically, the cushion 120 is an example of a first support member that supports the primary molded product 80 inside the hat-shaped cross-section, and the die 110 is an example of a second support member that supports the primary molded product 80 at lower end portions of the vertical wall portions 83.

The die 110 is fixed to a lower holder (not illustrated) of the press-molding apparatus 100. The die 110 is provided with a flange-supporting recessed portion 112 that supports the flange portions 84 (including the lower end portions of the vertical wall portions 83) of the primary molded product 80 when the primary molded product 80 is set. The die 110 is also provided with a pad movement surface 114 on which the pads 140 can move.

The cushion 120 is movably supported by the lower holder of the press-molding apparatus 100. The cushion 120 supports the set primary molded product 80 from inside the hat-shaped cross-section. Specifically, the cushion 120 supports the inside of the upper wall portion 82 and the vertical wall portions 83 of the primary molded product 80. The cushion 120 is biased upward (in the direction D1) by a biasing member 122, such as a spring.

The punch 130 is movably supported by an upper holder (not illustrated) of the press-molding apparatus 100. The punch 130 is positioned above the upper wall portion 82 of the set primary molded product 80, and moves downward (in the direction D2; the opposite direction to the direction D1) at the time of press working. The punch 130 moves downward in the direction D2 between the two pads 140, as illustrated in FIGS. 4 and 5, in a state where the upper wall portion 82 is sandwiched between the punch 130 and the cushion 120 as illustrated in FIG. 3, thereby press-molding the primary molded product 80. At this time, the punch 130 moves downward relative to the die 110, together with the cushion 120, thereby performing press working such that, while the height of the vertical wall portion 83 of the primary molded product 80 is reduced from h1 to h2, the thickness of the vertical wall portion 83 is increased from t1 to t2. The corner portions 85 and 86 are also thickened when the vertical wall portion 83 is thickened. Note that the vertical wall portion 83 is thickened while strain is caused, thus being hardened (work hardening). The punch 130 executes such press working for the entire longitudinal direction of the primary molded product 80.

The pad 140 is positioned outside the vertical wall portion 83 of the primary molded product 80, and faces the cushion 120 with the vertical wall portion 83 placed therebetween. The pad 140 is provided on the pad movement surface 114 of the die 110 to be movable in the lateral direction (direction D3 or direction D4). The pad 140 is biased in the direction D3 toward the vertical wall portion 83 by a biasing member 142, such as a spring. One end portion of the biasing member 142 is linked to the pad 140, and the other end portion thereof is linked to the die 110.

The biasing member 142 adjusts the position of the pad 140 during the press working such that contact between the pad 140 and the vertical wall portion 83 is maintained. More specifically, the pad 140 is biased in the direction D3 by the biasing member 142 to be pressed against the vertical wall portion 83. When the thickness of the vertical wall portion 83 is increased by thickening, the pad 140 moves in the direction D4 to oppose the biasing force of the biasing member 142, and the distance between the pad 140 and the cushion 120 is increased by the amount of increase in the thickness of the vertical wall portion 83. The pad 140 keeps its contact with the vertical wall portion 83 in this manner, thereby preventing buckling of the vertical wall portion 83.

Although the vertical wall portions 83 and the corner portions 85 and 86 of the primary molded product 80 are thickened in the above description, without being limited to this example, it is possible to thicken only the vertical wall portions 83. In addition, although the vertical wall portions 83 are thickened in the entire longitudinal direction of the primary molded product 80 in the above description, without being limited to this example, it is possible to thicken only part of the vertical wall portions 83 in the longitudinal direction.

1-3. Operation Example of Press-Molding Apparatus

Next, an operation example at the time of press working of the press-molding apparatus 100 will be described, still referring to FIGS. 3 to 5. This operation example starts from a state where the set primary molded product 80 is held by the cushion 120, the punch 130, and the pads 140, as illustrated in FIG. 3.

First, the punch 130 starts to move downward in the direction D2, and load is applied to the primary molded product 80. Accordingly, the cushion 120 also moves downward in the direction D2, to oppose the biasing force of the biasing member 122 in the direction D1. Thus, the vertical wall portion 83 of the primary molded product 80 having been subjected to the load shrinks in the direction D2, and expands in the direction D4 (the opposite direction to the direction D3), as illustrated in FIG. 4.

The pad 140 is biased in the direction D3 by the biasing member 142, but when the vertical wall portion 83 expands in the direction D4, force is applied to the pad 140 in the direction D4 from the vertical wall portion 83. This causes the pad 140 to move in the direction D4, to oppose the biasing force of the biasing member 142. At this time, the pad 140 biased by the biasing member 142 maintains its state of being in contact with the vertical wall portion 83, and thus can prevent the vertical wall portion 83 from warping and buckling. As a result, the vertical wall portion 83 can be thickened to the uniform thickness t2.

Then, the cushion 120 and the pad 140 keep moving until the punch 130 reaches the bottom dead point as illustrated in FIG. 5. Here, the biasing force of the biasing member 142 is adjusted such that the distance between the pad 140 and the cushion 120 does not exceed t2. Thus, the vertical wall portion 83 is thickened to the thickness t2. At this time, the corner portion 85 of the upper wall portion 82 and the vertical wall portion 83, and the corner portion 86 of the vertical wall portion 83 and the flange portion 84 are also thickened. Note that the vertical wall portion 83 is thickened while strain is caused, thus being hardened (work hardening).

Meanwhile, the upper wall portion 82 and the flange portion 84 of the primary molded product 80 maintain the thickness t1 until the punch 130 reaches the bottom dead point. As a result, when press molding is completed, the press-molded product 10 serving as the secondary molded product in which the vertical wall portions 13 and the corner portions 15 and 16 have been thickened, as illustrated in FIG. 1, is molded.

1-4. Effectiveness

The effectiveness of the press-molded product 10 molded by the above-described press-molding apparatus 100 will be described by using analysis results of 3-point bending simulation for the press-molded product 10.

Figure 6:
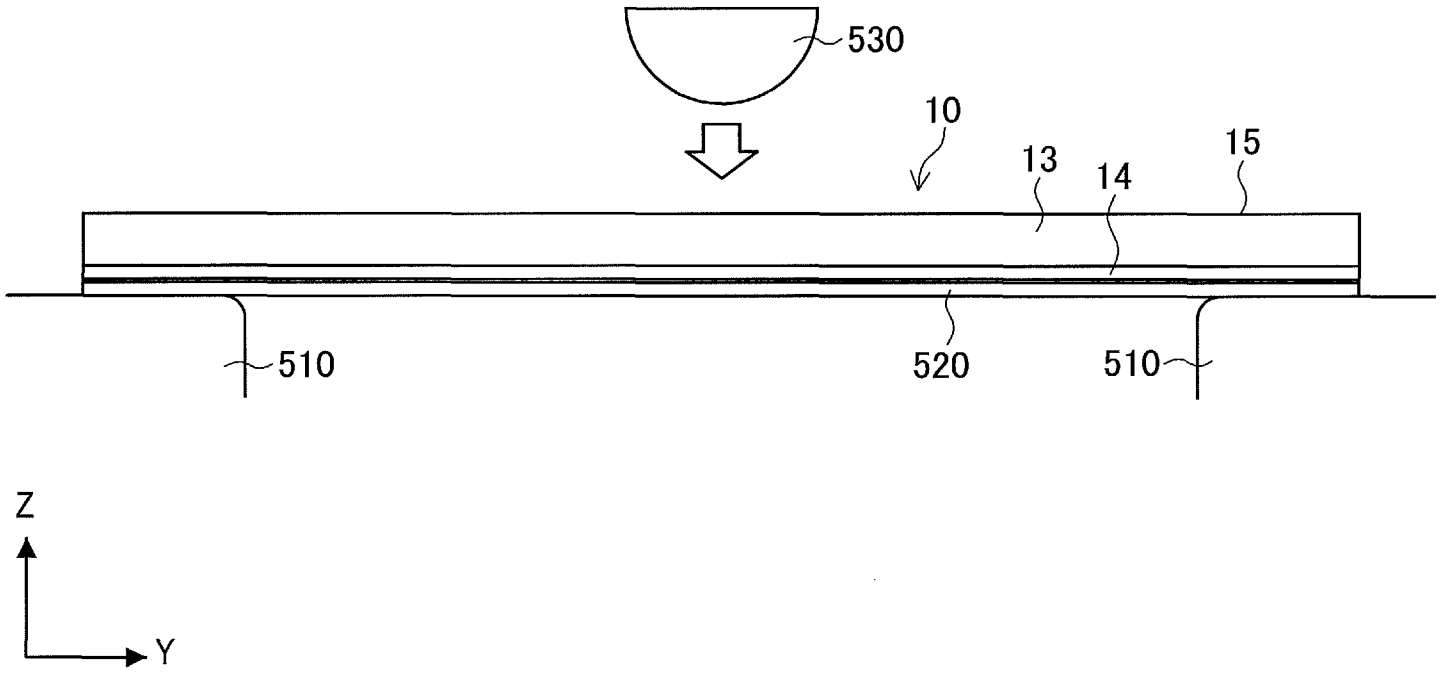
FIG. 6 is a schematic view for explaining conditions of 3-point bending simulation for a press-molded product.

FIG. 6 is a schematic view for explaining conditions of the 3-point bending simulation for the press-molded product 10. In the simulation, the press-molded product 10 is supported by support members 510 positioned on both end sides in the longitudinal direction, with a back plate 520 placed between the press-molded product 10 and the support members 510, as illustrated in FIG. 6. At this time, the press-molded product 10 is fixed to the back plate 520, which is a flat plate, by welding at the flange portion 14. Then, an indenter 530 applies predetermined load to the center side in the longitudinal direction of the press-molded product 10 supported by the support members 510. Thus, an area of the press-molded product 10 to which the load has been applied undergoes deformation and displacement.

The following description compares analysis results for the press-molded product 10 according to the present example in which the vertical wall portions 13 have been thickened with analysis results for a press-molded product according to Comparative Example 1 in which vertical wall portions have not been thickened, referring to FIGS. 7 to 9. Note that the simulation is performed for each of the cases where the support span between the two support members 510 supporting the press-molded product is 200 mm, 300 mm, and 600 mm. Here, the upper wall portion 12 and the flange portions 14 of the press-molded product 10 have a plate thickness of 1.0 mm, and the vertical wall portions 13 have an increased plate thickness (1.2 mm to 2.0 mm). An upper wall portion, vertical wall portions, and flange portions of the molded product according to Comparative Example 1 have a uniform plate thickness, which is 1.0 mm here.

Graphs of FIG. 7 show the analysis results of the 3-point bending simulation when the support span between the two support members 510 is 200 mm. Graphs of FIG. 8 show the analysis results of the 3-point bending simulation when the support span is 300 mm. Graphs of FIG. 9 show the analysis results of the 3-point bending simulation when the support span is 600 mm.

Figure 7A:
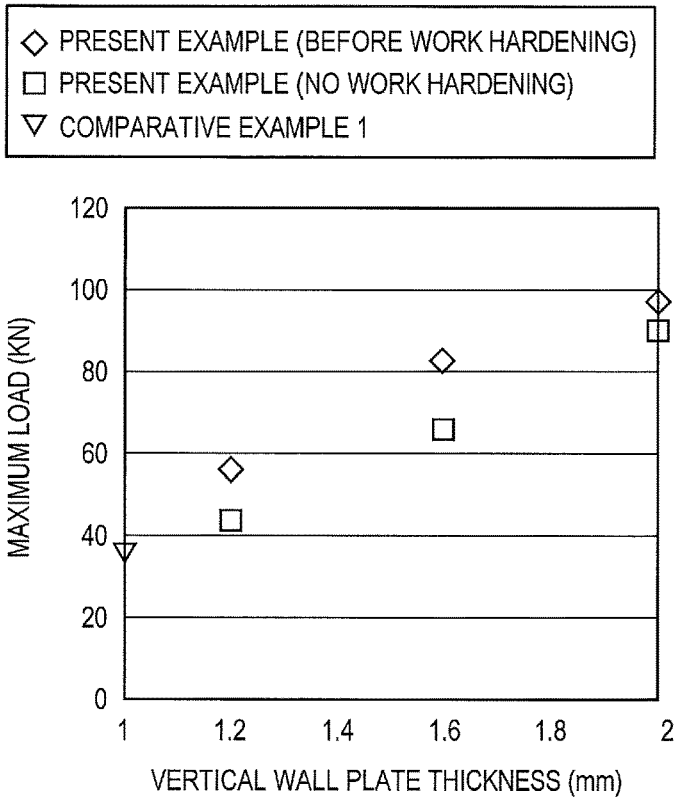
FIG. 7A is a graph showing the analysis results of the 3-point bending simulation when the support span is 200 mm.
Figure 7B:
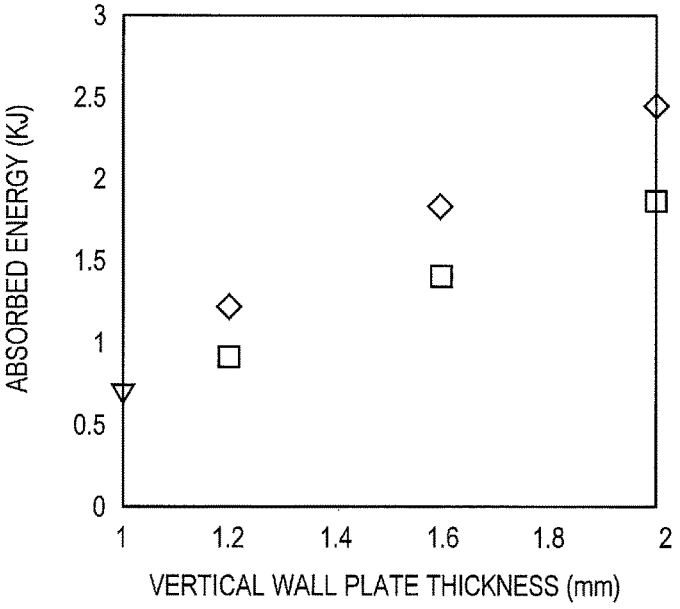
FIG. 7B is a graph showing the analysis results of the 3-point bending simulation when the support span is 200 mm.
Figure 8A:
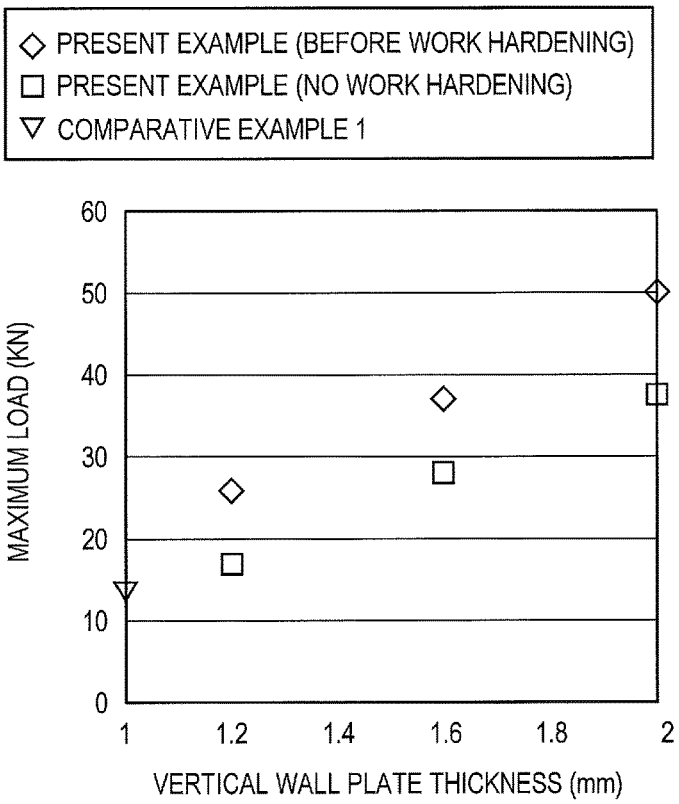
FIG. 8A is a graph showing the analysis results of the 3-point bending simulation when the support span is 300 mm.
Figure 8B:
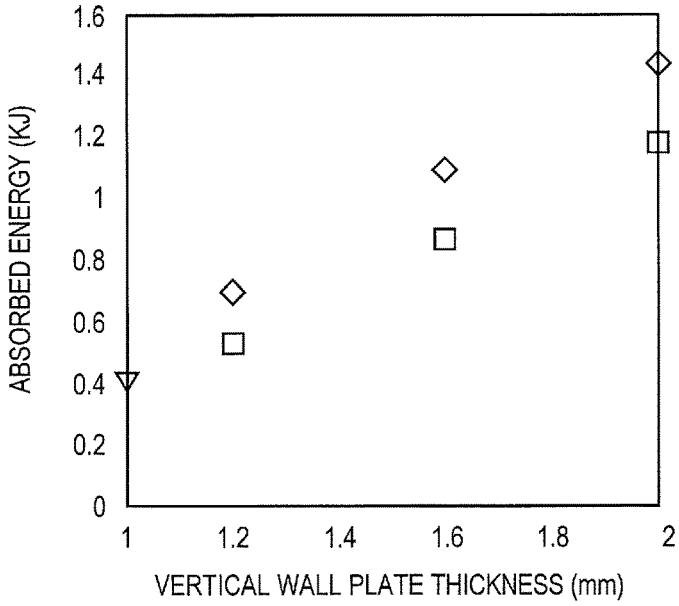
FIG. 8B is a graph showing the analysis results of the 3-point bending simulation when the support span is 300 mm.
Figure 9A:
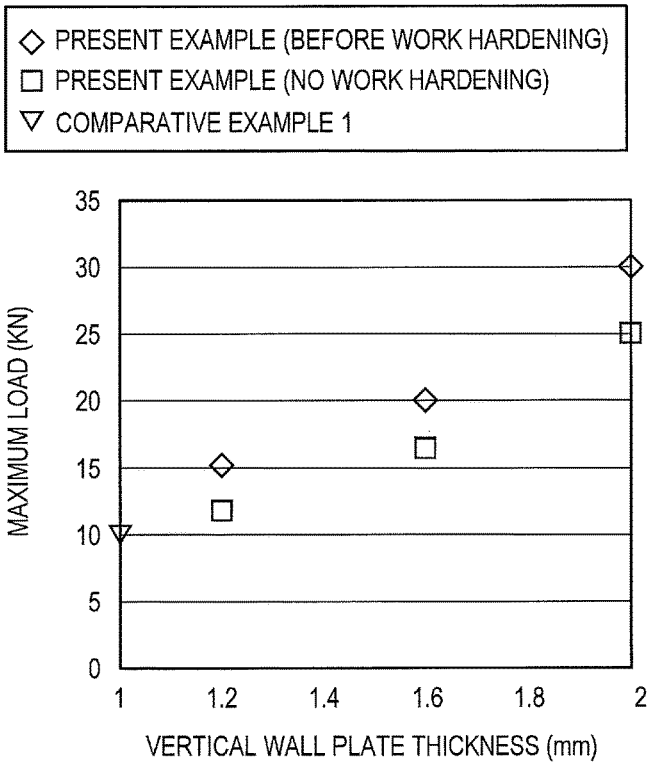
FIG. 9A is a graph showing the analysis results of the 3-point bending simulation when the support span is 600 mm.
Figure 9B:
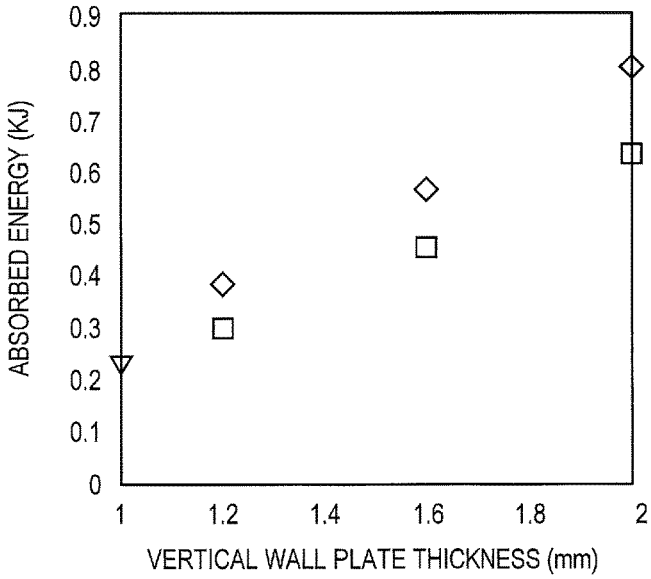
FIG. 9B is a graph showing the analysis results of the 3-point bending simulation when the support span is 600 mm.

The horizontal axis of the six graphs of FIGS. 7 to 9 represents the plate thickness of the vertical wall portion 13. The vertical axis of each graph of FIGS. 7A, 8A, and 9A represents the maximum load at which the press-molded product undergoes displacement, and the vertical axis of each graph of FIGS. 7B, 8B, and 9B represents energy absorbed by the press-molded product. Note that the shown analysis results include analysis results not reflecting work hardening and analysis results reflecting work hardening. As is apparent from FIGS. 7 to 9, the maximum load at which the press-molded product 10 undergoes displacement and the absorbed energy increase as the plate thickness of the vertical wall portion 13 increases. In addition, the maximum load and the absorbed energy further increase when work hardening is reflected. That is, the press-molded product 10 according to the present example is not easily deformed and absorbs a large amount of energy. Thus, when the press-molded product 10 according to the first embodiment is used for a center pillar of a car, collision performance can be improved.

Figure 10:
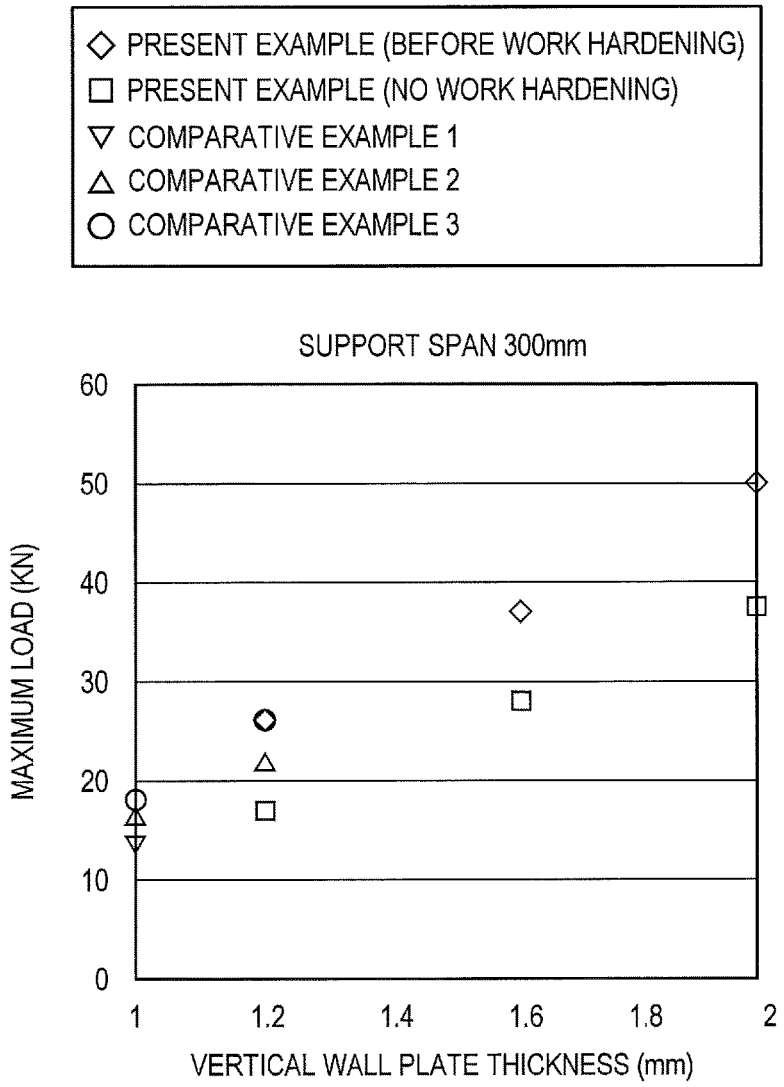
FIG. 10 is a graph showing the analysis results of the 3-point bending simulation.
Figure 11:
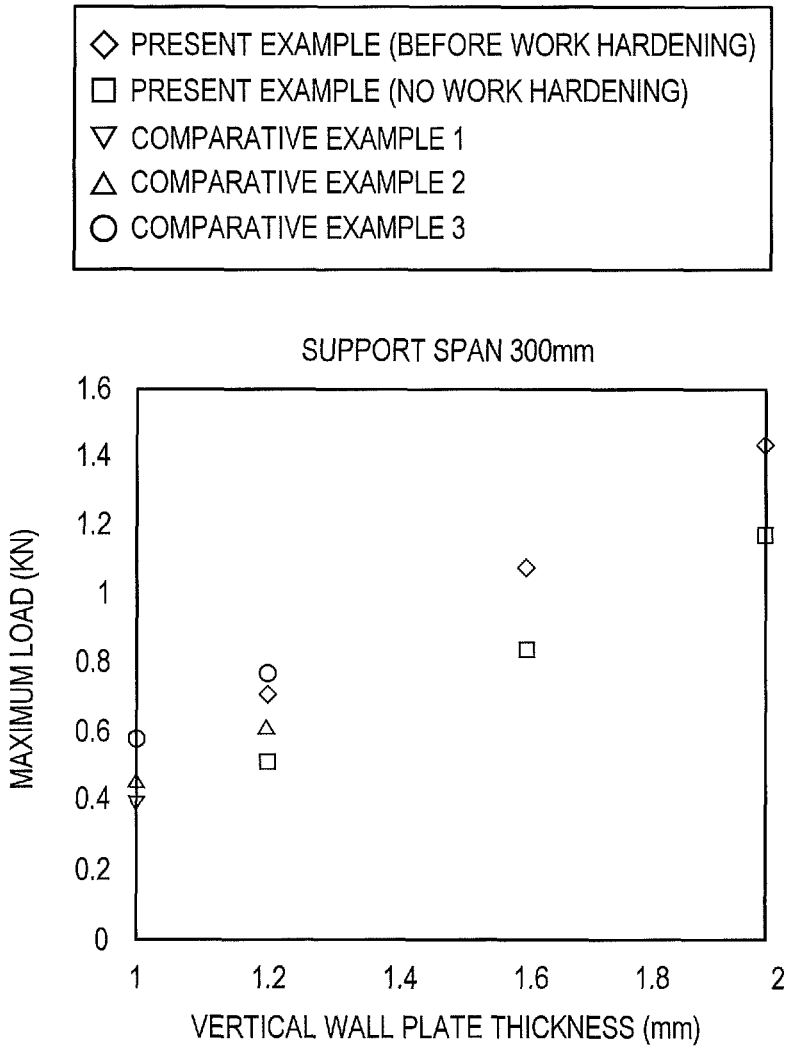
FIG. 11 is a graph showing the analysis results of the 3-point bending simulation.

Next, analysis results of 3-point bending simulation for the press-molded product 10 according to the present example and for press-molded products according to Comparative Examples 2 and 3 having different tensile strengths will be described referring to FIGS. 10 and 11. FIGS. 10 and 11 are graphs showing the analysis results of the 3-point bending simulation.

The analysis results of the press-molded product 10 according to the present example shown in FIGS. 10 and 11 are the same as those of FIGS. 8A and 8B. As for the molded products of Comparative Examples 2 and 3, the cases where an upper wall portion, vertical wall portions, and flange portions have a uniform plate thickness, which is 1.0 mm and 1.2 mm here, are analyzed. Here, the molded product of Comparative Example 2 is made of a material with a 980

MPa-class tensile strength. The molded product of Comparative Example 3 is made of a material with a 1180 MPa-class tensile strength.

As is apparent from FIGS. 10 and 11, the press-molded product 10 of the present example exhibits characteristics equivalent to or better than those of the molded product of Comparative Example 2 with a 980 MPa-class tensile strength and, when the plate thickness of the vertical wall portion of the press-molded product 10 is set to 1.2 mm, exhibits characteristics equivalent to those of the molded product of Comparative Example 3 with a 1180 MPa-class tensile strength having the plate thickness 1.2 mm. Therefore, using the press-molding apparatus 100 according to the first embodiment makes it possible to secure characteristics similar to those of a molded product according to a material with a high tensile strength by performing press molding using a material with a low tensile strength. This makes it possible to maintain characteristics of the press-molded product 10 while reducing material weight.

1-5. Modification

Configuration examples of a press-molded product 20 and a press-molding apparatus 150 according to a modification of the first embodiment will be described referring to FIGS. 12 to 16.

1-5-1. Configuration Example of Press-Molded Product

Figure 12:
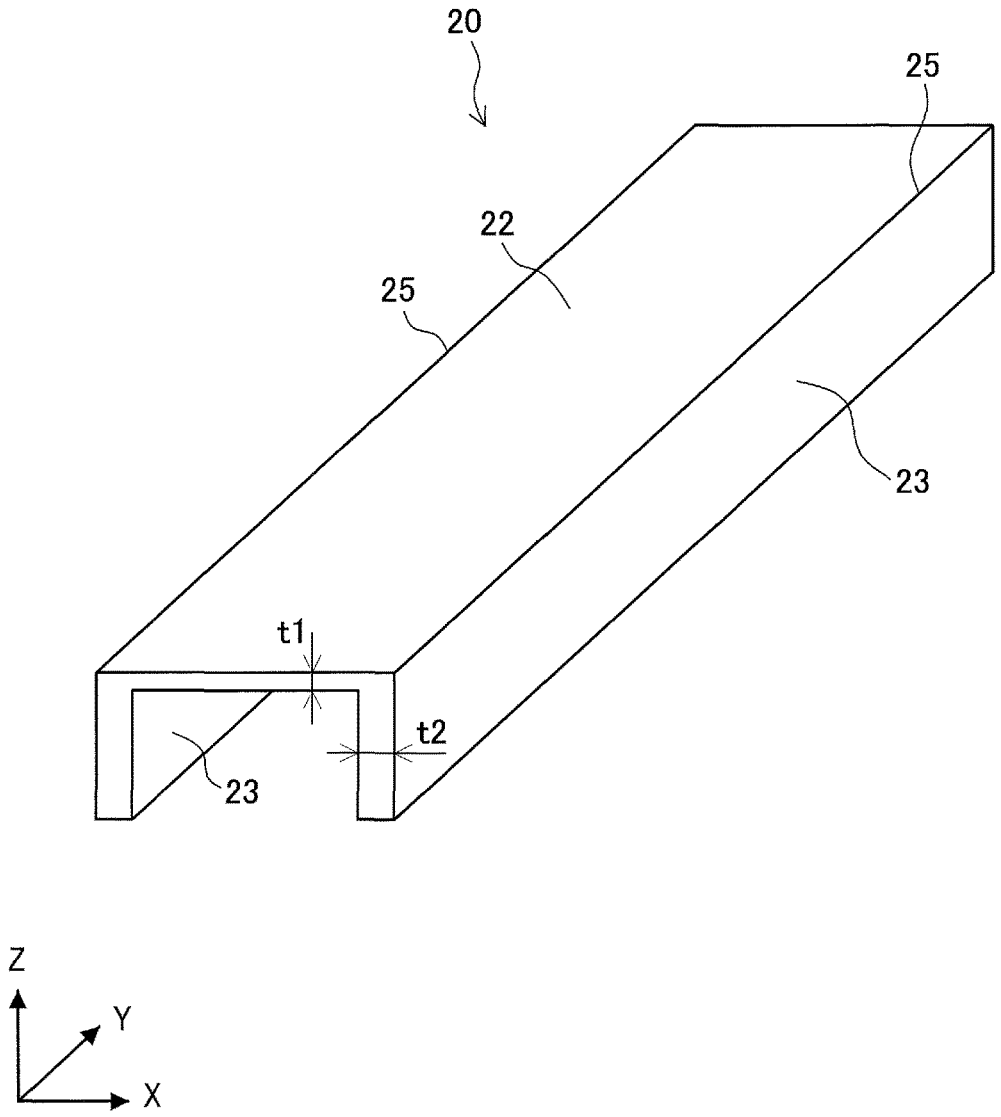
FIG. 12 is a perspective view of a configuration example of a press-molded product according to a modification of the first embodiment.
Figure 13:
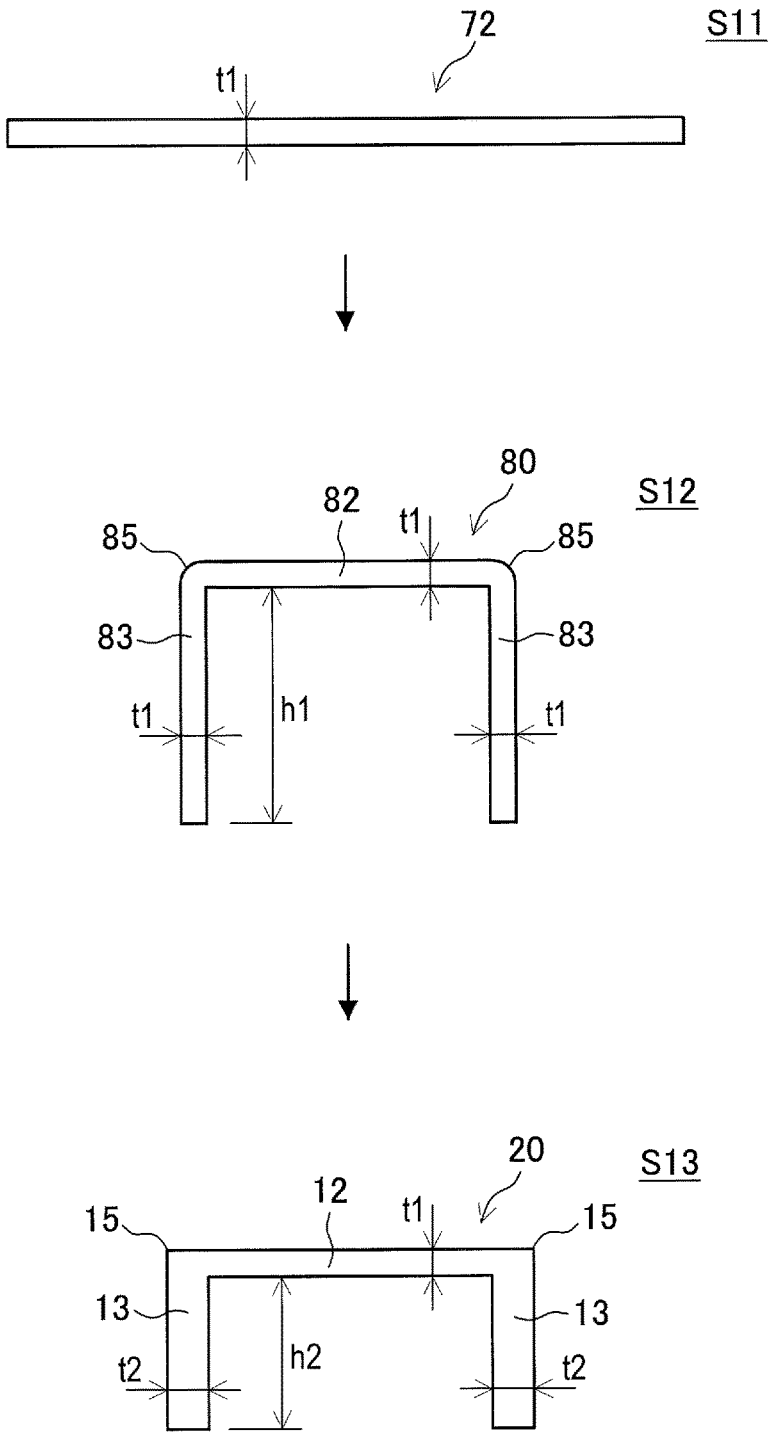
FIG. 13 is a schematic view of an example of a manufacturing process of the press-molded product according to the modification of the first embodiment.

The configuration example of the press-molded product 20 according to the modification of the first embodiment will be described referring to FIGS. 12 and 13. FIG. 12 is a perspective view of the configuration example of the press-molded product 20 according to the modification of the first embodiment. FIG. 13 is a schematic view of an example of a manufacturing process of the press-molded product 20 according to the modification of the first embodiment.

The press-molded product 20 is a long molded product extending with a so-called U-shaped cross-section, as illustrated in FIG. 12. Specifically, the press-molded product 20 includes an upper wall portion 22 and vertical wall portions 23, but does not include the flange portions 14 of the press-molded product 10 illustrated in FIG. 1. Hence, the upper wall portion 22 or the vertical wall portion 23 is provided with a fastening hole for fastening the press-molded product 20 to the vehicle main body.

Also in the press-molded product 20, the vertical wall portion 23 is thickened to the thickness t2, which is larger than the thickness t1 of the upper wall portion 22. In addition, a corner portion 25 between the upper wall portion 22 and the vertical wall portion 23 is thickened to be flush with the vertical wall portion 23. Thus, the vertical wall portion 23 and the corner portion 25 have increased rigidity.

Like the press-molded product 10, the press-molded product 20 with the above-described configuration is molded by performing press working twice (a first molding step S12 and a second molding step S13 illustrated in FIG. 13) on the blank 70, which is a flat plate with the plate thickness t1, prepared in a preparation step S11, as illustrated in FIG. 13. That is, the primary molded product 80 having a hat-shaped cross-section with the plate thickness t1 is formed by the first molding step S12. Then, the press-molded product 20 serving as a secondary molded product in which the vertical wall portions have shrunk to the height h2 and have been thickened to the thickness t2 accordingly is molded by the second molding step S13.

1-5-2. Configuration Example and Operation Example of Press-Molding Apparatus Examples of the configuration and operation of the press-molding apparatus 150 according to the modification of the first embodiment will be described referring to FIGS. 14 to 16. The press-molding apparatus 150 also performs press working of the primary molded product 80, thereby molding the press-molded product 20 serving as the secondary molded product in which the vertical wall portions 23 have been thickened.

Figure 14:
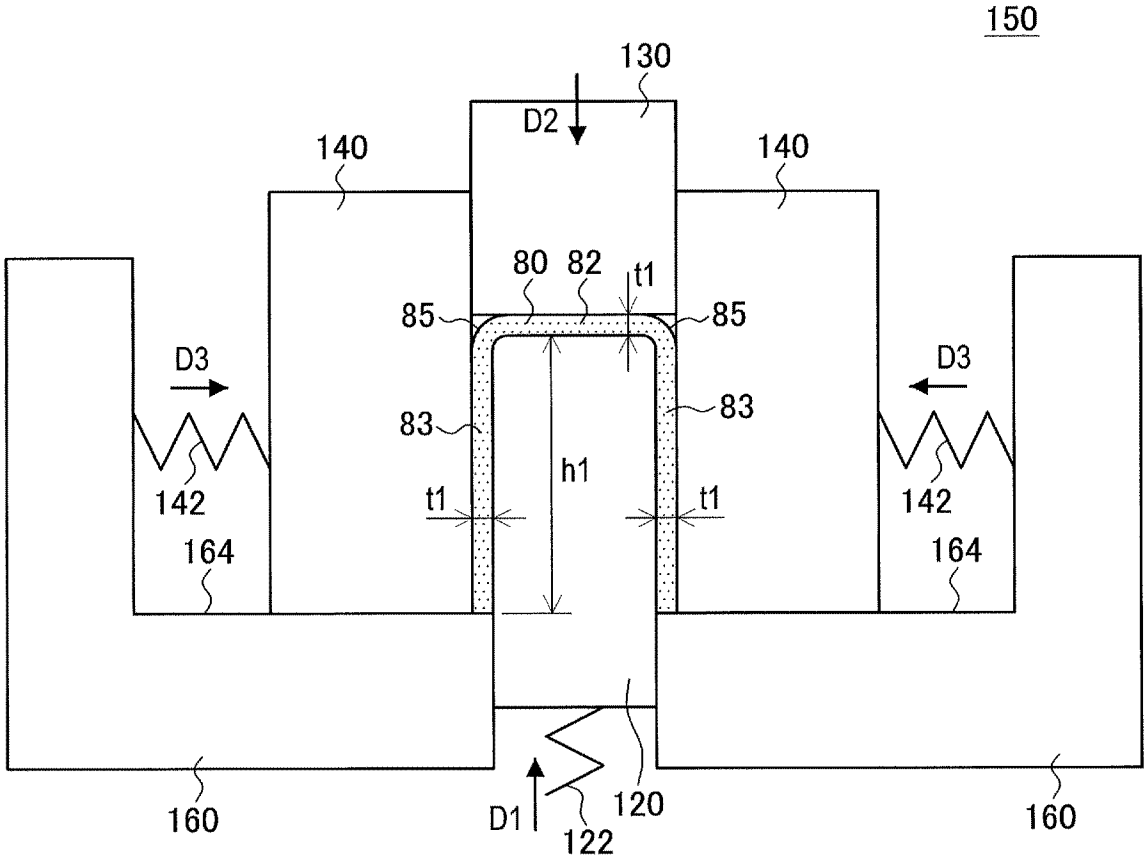
FIG. 14 is a schematic view for explaining a configuration example of a press-molding apparatus according to the modification of the first embodiment.
Figure 15:
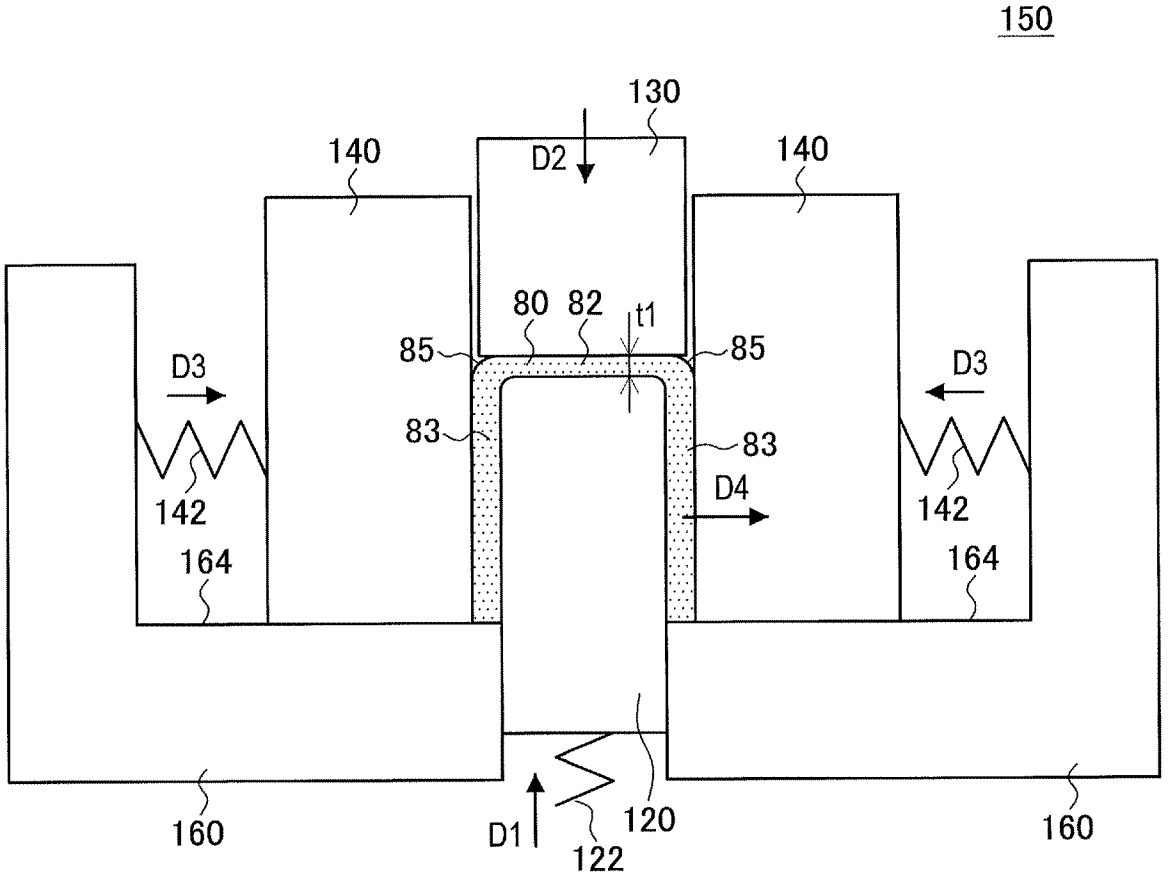
FIG. 15 is a schematic view for explaining the configuration example of the press-molding apparatus according to the modification of the first embodiment.
Figure 16:
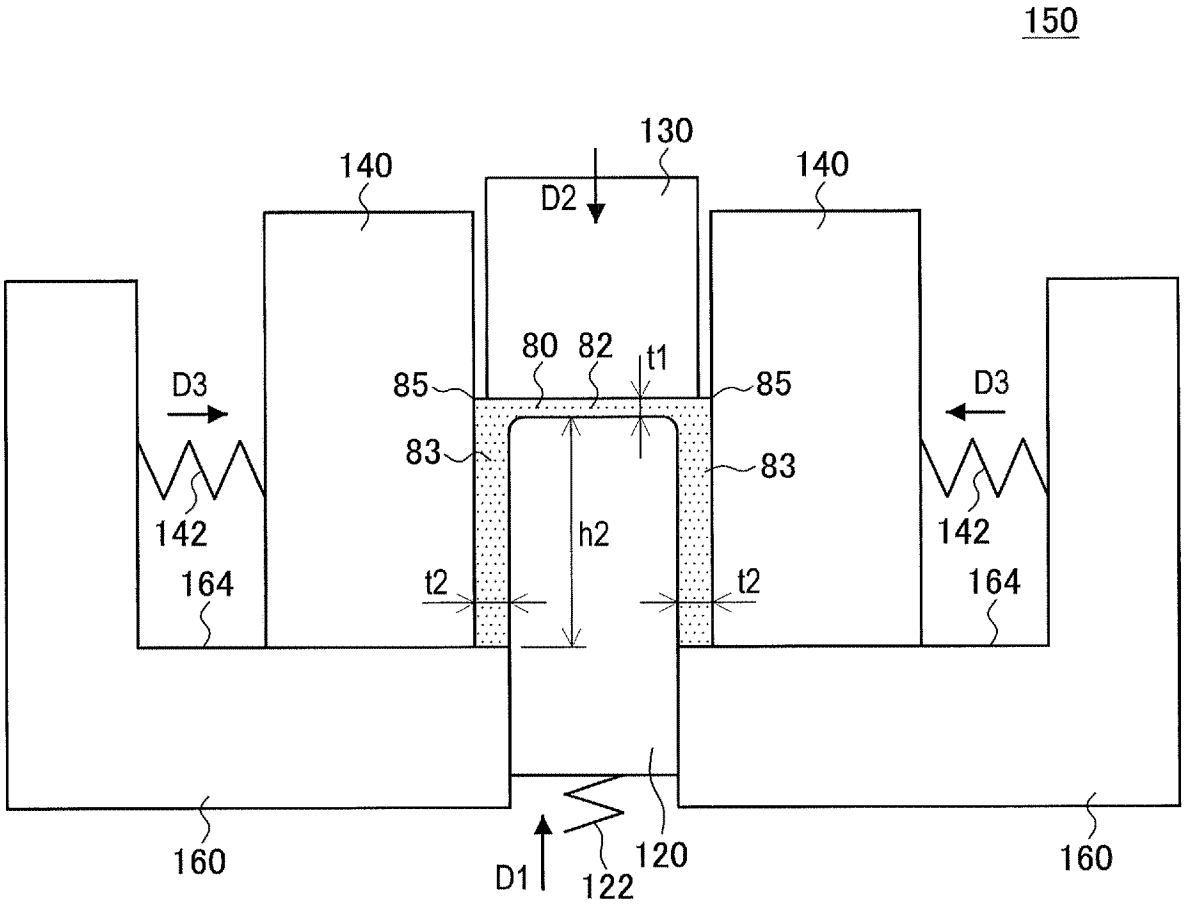
FIG. 16 is a schematic view for explaining the configuration example of the press-molding apparatus according to the modification of the first embodiment.

FIGS. 14 to 16 are schematic views for explaining the configuration example of the press-molding apparatus 150 according to the modification of the first embodiment. Note that FIG. 14 illustrates a state of the press-molding apparatus 150 just before starting press working for thickening, FIG. 15 illustrates a state of the press-molding apparatus 150 during the press working, and FIG. 16 illustrates a state of the press-molding apparatus 150 at the end of the press working (a punch is positioned at the bottom dead point).

The press-molding apparatus 150 includes, as illustrated in FIGS. 14 to 16, a die 160, the cushion 120, the punch 130, and the pads 140. The die 160 has the same configuration as the die 110 of the press-molding apparatus 100 illustrated in FIGS. 3 to 5, except that the flange-supporting recessed portion 112 is not formed. In addition, configurations of the cushion 120, the punch 130, and the pads 140 of the press-molding apparatus 150 are the same as those of the press-molding apparatus 100. Therefore, the main functions of the die 160, the cushion 120, the punch 130, and the pads 140 of the press-molding apparatus 150 are similar to those of the press-molding apparatus 100.

Next, the operation example at the time of press working of the press-molding apparatus 150 will be described.

In this operation example, the punch 130 and the cushion 120 start to move downward in the direction D2 from a state illustrated in FIG. 14, and load is applied to the primary molded product 80. Thus, the vertical wall portion 83 of the primary molded product 80 shrinks in the direction D2 and expands in the direction D4, as illustrated in FIG. 15. At this time, the pad 140 biased by the biasing member 142 maintains its state of being in contact with the vertical wall portion 83, and thus can prevent the vertical wall portion 83 from warping and buckling. As a result, the vertical wall portion 83 can be thickened to the uniform thickness t2.

Then, the cushion 120 and the pad 140 keep moving until the punch 130 reaches the bottom dead point as illustrated in FIG. 16. Here, the biasing force of the biasing member 142 is adjusted such that the distance between the pad 140 and the cushion 120 does not exceed t2. Thus, the vertical wall portion 83 is thickened to the thickness t2. The corner portion 85 of the upper wall portion 82 and the vertical wall portion 83 is also thickened. Note that the vertical wall portion 83 is thickened while strain is caused, thus being hardened.

Meanwhile, the upper wall portion 82 of the primary molded product 80 maintains the thickness t1 until the punch 130 reaches the bottom dead point. As a result, when press molding is completed, the press-molded product 20 serving as the secondary molded product in which the vertical wall portions 23 and the corner portions 25 have been thickened, as illustrated in FIG. 12, is molded.

2. Second Embodiment

A second embodiment will be described. A press-molded product according to the second embodiment is the same as the press-molded product 10 according to the first embodiment. Meanwhile, a press-molding apparatus according to the second embodiment is different from the press-molding apparatus 100 according to the first embodiment. Hence, a configuration example and an operation example of the press-molding apparatus according to the second embodiment will be described below.

2-1. Configuration Example of Press-Molding Apparatus

A configuration example of a press-molding apparatus 200 according to the second embodiment will be described referring to FIGS. 17 to 19. The press-molding apparatus 200 performs press working of the primary molded product 80 serving as a work, thereby molding the press-molded product 10 serving as the secondary molded product in which the vertical wall portions 13 have been thickened.

Figure 17:
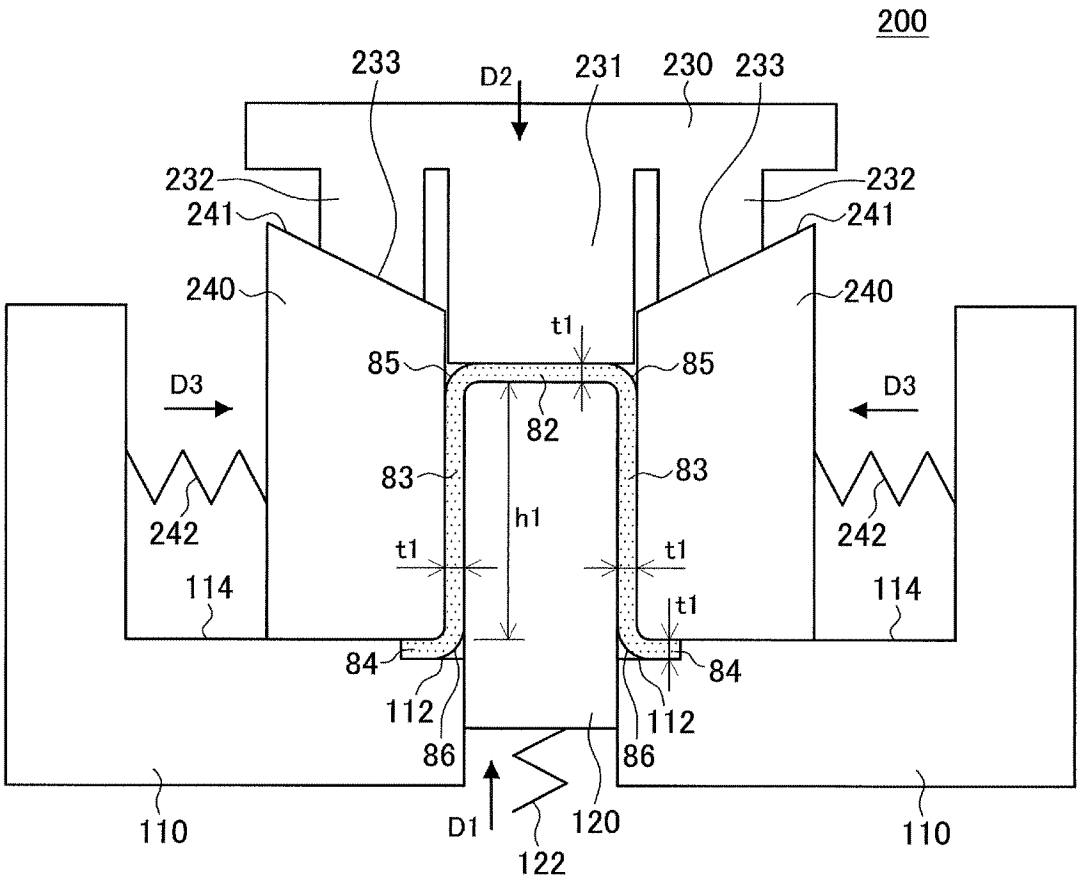
FIG. 17 is a schematic view for explaining a configuration example of a press-molding apparatus according to a second embodiment.
Figure 18:
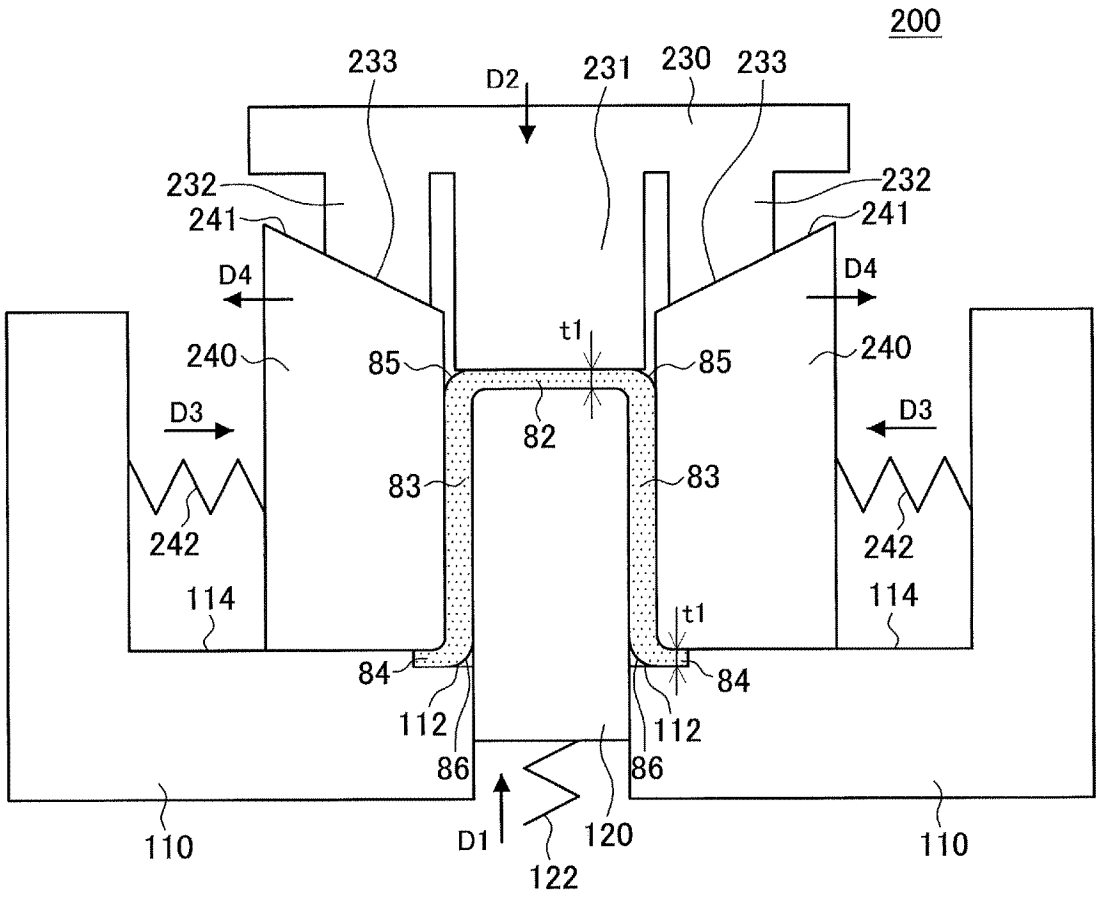
FIG. 18 is a schematic view for explaining the configuration example of the press-molding apparatus according to the second embodiment.
Figure 19:
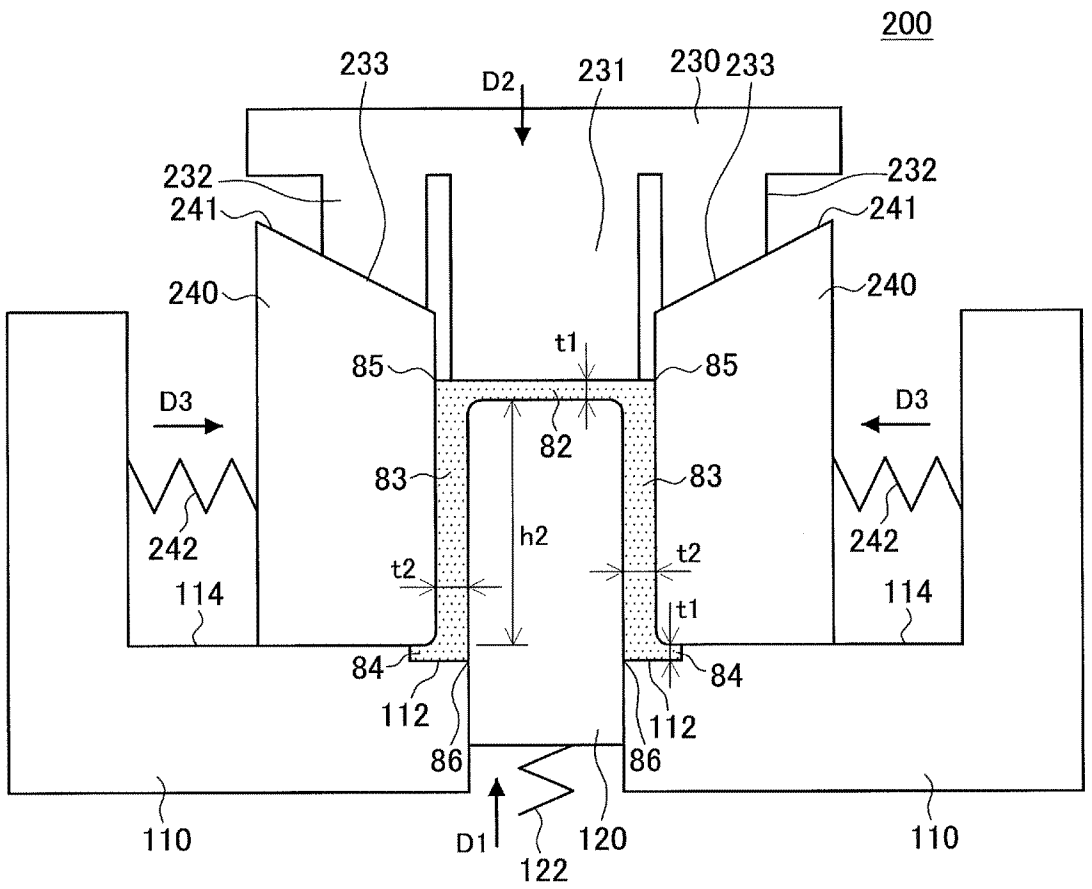
FIG. 19 is a schematic view for explaining the configuration example of the press-molding apparatus according to the second embodiment.

FIGS. 17 to 19 are schematic views for explaining the configuration example of the press-molding apparatus 200 according to the second embodiment. Note that FIG. 17 illustrates a state of the press-molding apparatus 200 just before starting press working for thickening, FIG. 18 illustrates a state of the press-molding apparatus 200 during the press working, and FIG. 19 illustrates a state of the press-molding apparatus 200 at the end of the press working (a punch is positioned at the bottom dead point).

The press-molding apparatus 200 includes, as illustrated in FIGS. 17 to 19, the die 110, the cushion 120, a punch 230, which is an example of a punch member, and pads 240, which are examples of pad members. Note that in the press-molding apparatus 200 according to the present embodiment, configurations of the die 110 and the cushion 120 are similar to those of the press-molding apparatus 100 according to the above first embodiment. Hence, detailed description of these elements is omitted.

The punch 230 is movably supported by an upper holder (not illustrated) of the press-molding apparatus 200. The punch 230 includes a punch portion 231 positioned above the upper wall portion 82 of the set primary molded product 80, and moves downward (in the direction D2) at the time of press working. The punch portion 231 moves downward in the direction D2 between the two pads 240, as illustrated in FIGS. 18 and 19, in a state where the upper wall portion 82 is sandwiched between the punch portion 231 and the cushion 120 as illustrated in FIG. 17, thereby press-molding the primary molded product 80. At this time, the punch portion 231 moves downward relative to the die 110, together with the cushion 120, thereby performing press working such that, while the height of the vertical wall portion 83 of the primary molded product 80 is reduced from h1 to h2, the thickness of the vertical wall portion 83 is increased from t1 to t2. The corner portions 85 and 86 are also thickened when the vertical wall portion 83 is thickened. Note that the vertical wall portion 83 is thickened while strain is caused, thus being hardened. The punch portion 231 executes such press working for the entire longitudinal direction of the primary molded product 80.

In addition, the punch 230 includes pressing portions 232 that press the pad 240 at the time of press working. The pressing portions 232 are provided on both sides of the punch portion 231. When the punch 230 moves downward in the direction D2, the pressing portion 232 presses the pad 240 in contact therewith. The tip side of the pressing portion 232 is provided with a pressing surface 233 inclined like an inclined surface 241 of the pad 240.

The pad 240 is positioned outside the vertical wall portion 83 of the primary molded product 80, and faces the cushion 120 with the vertical wall portion 83 placed therebetween. The pad 240 is provided on the pad movement surface 114 of the die 110 to be movable in the lateral direction (direction D3 or direction D4). The inclined surface 241 is formed at the upper surface of the pad 240. The inclined surface 241 is inclined so as to be higher at positions farther from the cushion 120. Therefore, when the inclined surface 241 is pressed by the pressing surface 233 at the time of press working by the punch 230, the pad 240 moves in a direction going away from the cushion 120 (direction D4). At a time point where the punch 230 is positioned at the bottom dead point illustrated in FIG. 19, the distance between the pad 240 and the cushion 120 is the same as the increased thickness t2 of the vertical wall portion 83 of the primary molded product 80.

Here, an inclination angle of the inclined surface 241 is set such that a state where the pad 240 is in contact with the vertical wall portion 83 being thickened is maintained while the pad 240 moves in the direction D4 during the press working. This prevents the vertical wall portion 83 from warping when the vertical wall portion 83 is thickened, and thus can effectively prevent the vertical wall portion 83 from buckling. As described above, in the first embodiment, the pressing portion 232 and the inclined surface 241 constitute a distance adjustment mechanism that enlarges the distance between the cushion 120 and the pad 240 concurrently with the downward movement of the punch 230 during the press working.

Furthermore, the pad 240 is biased in the direction D3 toward the vertical wall portion 83 by a biasing member 242, such as a spring. One end portion of the biasing member 242 is linked to the pad 240, and the other end portion thereof is linked to the die 110. Biasing the pad 240 in this manner prevents the pad 240 pressed by the pressing portion 232 at the time of press working from popping out in the direction D4, making it possible to maintain contact between the pad 240 and the vertical wall portion 83.

Although the vertical wall portions 83 and the corner portions 85 and 86 of the primary molded product 80 are thickened in the above description, without being limited to this example, it is possible to thicken only the vertical wall portions 83. In addition, although the vertical wall portions 83 are thickened in the entire longitudinal direction of the primary molded product 80 in the above description, without being limited to this example, it is possible to thicken only part of the vertical wall portions 83 in the longitudinal direction.

2-2. Operation Example of Press-Molding Apparatus

Next, an operation example at the time of press working of the press-molding apparatus 200 will be described, still referring to FIGS. 17 to 19. This operation example starts from a state where the set primary molded product 80 is held by the cushion 120, the punch 230, and the pads 240, as illustrated in FIG. 17.

First, the punch 230 starts to move downward in the direction D2, and load is applied to the primary molded product 80. Accordingly, the cushion 120 also moves downward in the direction D2, to oppose the biasing force of the biasing member 122 in the direction D1.

In addition, when the punch 230 moves downward in the direction D2, the pressing portion 232 presses the inclined surface 241 of the pad 240; thus, the pad 240 moves in the direction D4, to oppose the biasing force of the biasing member 242. This increases the gap between the pad 240 and the cushion 120 as illustrated in FIG. 18. When the pad 240 moves in the direction D4, the vertical wall portion 83 of the primary molded product 80 having been subjected to the load from the punch portion 231 shrinks in the direction D2, and expands in the direction D4 so as to fill the gap. At this time, the pad 240 moves in the direction D4 while maintaining its contact with the vertical wall portion 83 being thickened, and thus can prevent the vertical wall portion 83 from warping and buckling. As a result, the vertical wall portion 83 can be thickened to the uniform thickness t2.

Then, the cushion 120 and the pad 240 keep moving until the punch 230 reaches the bottom dead point as illustrated in FIG. 19. Then, when the punch 230 reaches the bottom dead point, the distance between the pad 240 and the cushion 120 which have moved becomes the same as the increased thickness t2 of the vertical wall portion 83. Thus, the vertical wall portion 83 is thickened to the thickness t2. At this time, the corner portion 85 of the upper wall portion 82 and the vertical wall portion 83, and the corner portion 86 of the vertical wall portion 83 and the flange portion 84 are also thickened. Note that the vertical wall portion 83 is thickened while strain is caused, thus being hardened.

Meanwhile, the upper wall portion 82 and the flange portion 84 of the primary molded product 80 maintain the thickness t1 until the punch 230 reaches the bottom dead point. As a result, when press working is completed, the press-molded product 10 serving as the secondary molded product in which the vertical wall portions 13 and the corner portions 15 and 16 have been thickened, as illustrated in FIG. 1, is molded.

2-3. Modification

Configuration examples of the press-molded product 20 and a press-molding apparatus 250 according to a modification of the second embodiment will be described referring to FIGS. 20 to 22.

2-3-1. Configuration Example and Operation Example of Press-Molding Apparatus Examples of the configuration and operation of the press-molding apparatus 250 according to the modification of the second embodiment will be described referring to FIGS. 20 to 22. The press-molding apparatus 250 also performs press working of the primary molded product 80, thereby molding the press-molded product 20 serving as the secondary molded product in which the vertical wall portions 23 have been thickened.

Figure 20:
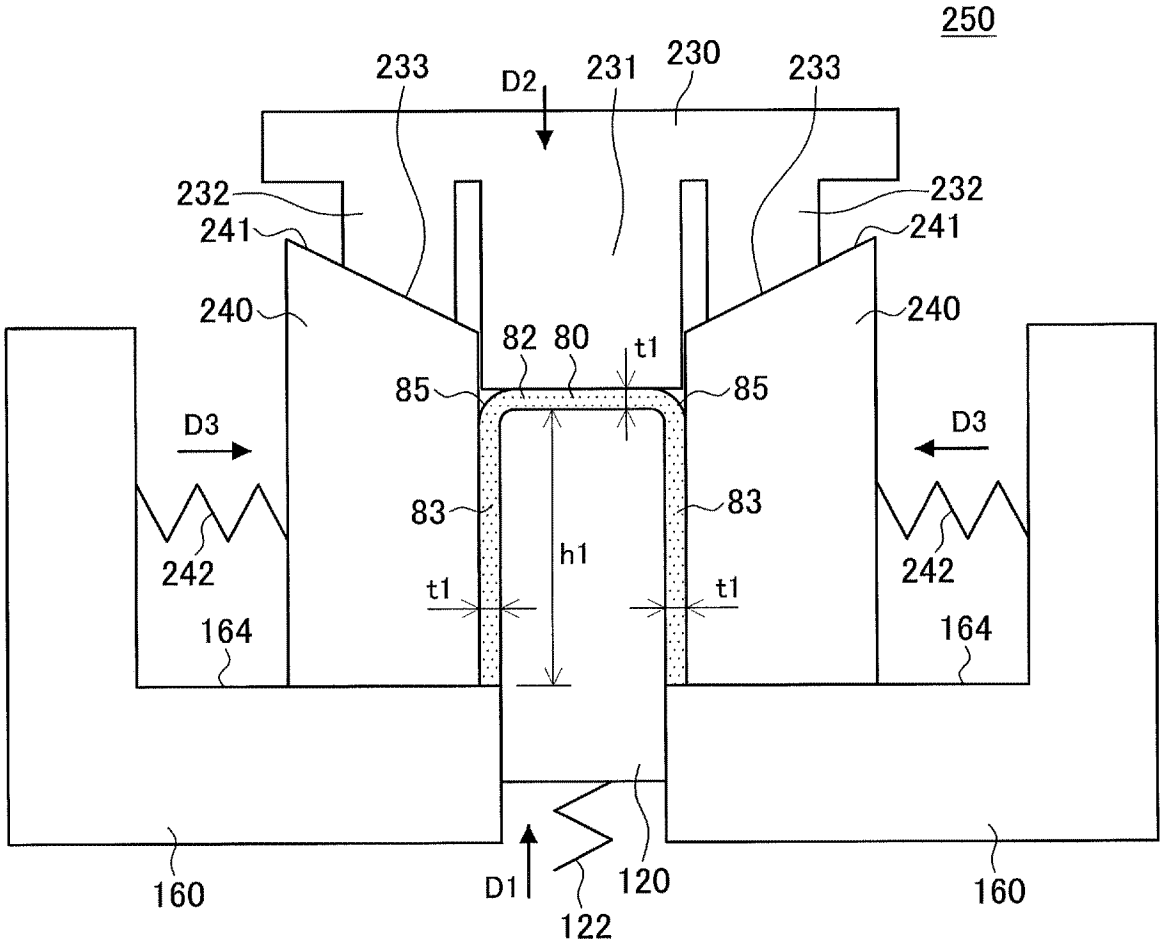
FIG. 20 is a schematic view for explaining a configuration example of a press-molding apparatus according to a modification of the second embodiment.
Figure 21:
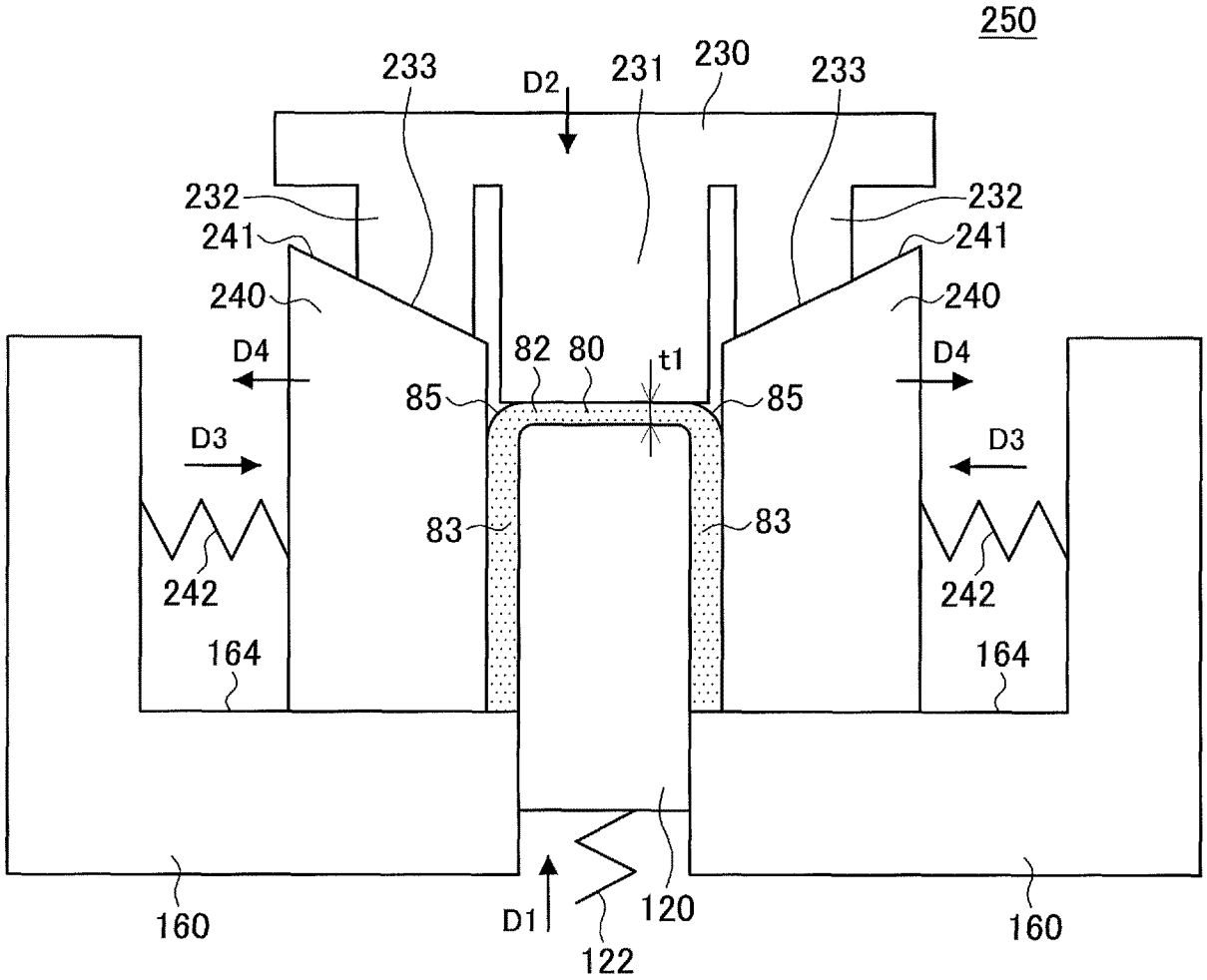
FIG. 21 is a schematic view for explaining the configuration example of the press-molding apparatus according to the modification of the second embodiment.
Figure 22:
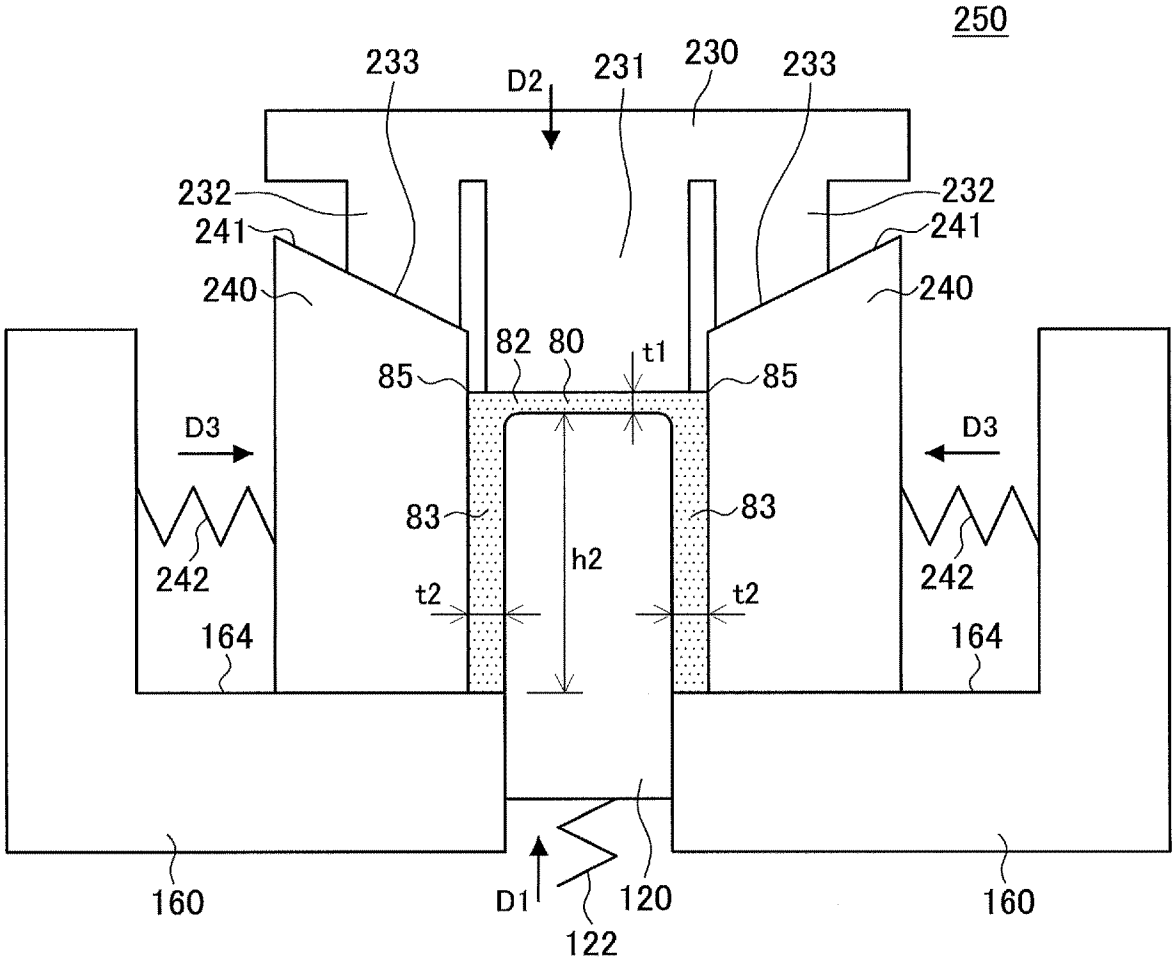
FIG. 22 is a schematic view for explaining the configuration example of the press-molding apparatus according to the modification of the second embodiment.

FIGS. 20 to 22 are schematic views for explaining the configuration example of the press-molding apparatus 250 according to the modification of the second embodiment. Note that FIG. 20 illustrates a state of the press-molding apparatus 250 just before starting press working for thickening, FIG. 21 illustrates a state of the press-molding apparatus 250 during the press working, and FIG. 22 illustrates a state of the press-molding apparatus 250 at the end of the press working (a punch is positioned at the bottom dead point).

The press-molding apparatus 250 includes, as illustrated in FIGS. 20 to 22, the die 160, the cushion 120, the punch 230, and the pads 240. Note that in the press-molding apparatus 250 according to this modification, a configuration of the die 160 is similar to that of the press-molding apparatus 150 according to the above modification of the first embodiment. In addition, configurations of the cushion 120, the punch 230, and the pads 240 are the same as those of the press-molding apparatus 200. Hence, in this modification, detailed description of individual elements is omitted.

Next, the operation example at the time of press working of the press-molding apparatus 250 will be described.

In this operation example, the punch 230 and the cushion 120 start to move downward in the direction D2 from a state illustrated in FIG. 20, and load is applied to the primary molded product 80.

In addition, when the punch 230 moves downward in the direction D2, the pressing portion 232 presses the inclined surface 241 of the pad 240; thus, the pad 240 moves in the direction D4, which increases the gap between the pad 240 and the cushion 120 as illustrated in FIG. 20. At this time, the vertical wall portion 83 of the primary molded product 80 having been subjected to the load from the punch portion 231 shrinks in the direction D2, and expands in the direction D4 so as to fill the gap. Here, the pad 240 moves in the direction D4 while maintaining its contact with the vertical wall portion 83 being thickened; thus, the thickness of the vertical wall portion 83 is increased substantially uniformly. At this time, the corner portion 85 of the upper wall portion 82 and the vertical wall portion 83, and the corner portion 86 of the vertical wall portion 83 and the flange portion 84 are also thickened.

Then, the cushion 120 and the pad 240 keep moving until the punch 230 reaches the bottom dead point as illustrated in FIG. 22. Then, when the punch 230 reaches the bottom dead point, the distance between the pad 240 and the cushion 120 which have moved becomes the same as the increased thickness t2 of the vertical wall portion 83. Thus, when being thickened to the thickness t2, the vertical wall portion 83 can be prevented from warping and buckling. As a result, the vertical wall portion 83 can be thickened to the uniform thickness t2.

Meanwhile, the upper wall portion 82 of the primary molded product 80 maintains the thickness t1 until the punch 230 reaches the bottom dead point. As a result, when press working is completed, the press-molded product 20 serving as the secondary molded product in which the vertical wall portions 23 and the corner portions 25 have been thickened, as illustrated in FIG. 12, is molded.

3. Third Embodiment

3-1. Overview of Press-Molded Product

Figure 23:
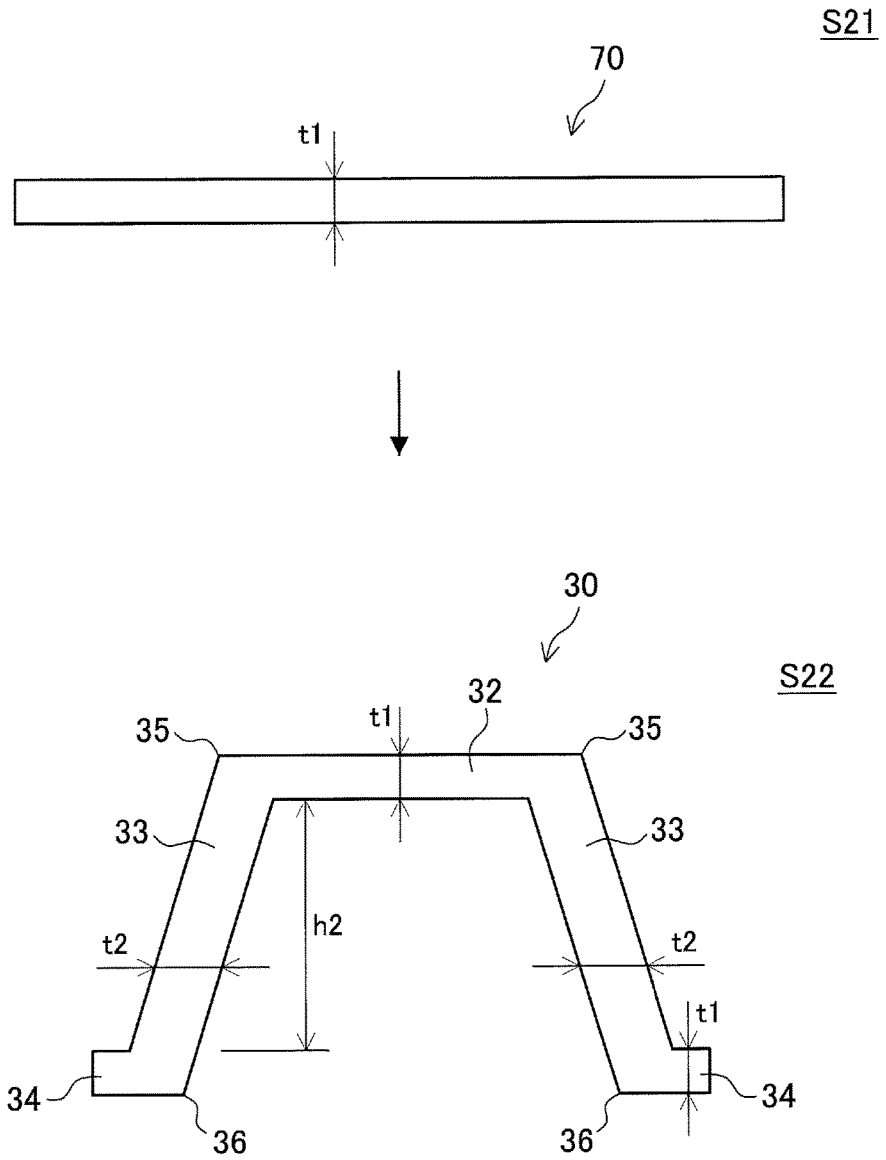
FIG. 23 is a schematic view of an example of a manufacturing process of a press-molded product according to a third embodiment.

An overview of a press-molded product 30 according to a third embodiment will be described referring to FIG. 23. FIG. 23 is a schematic view of an example of a manufacturing process of the press-molded product 30 according to the third embodiment.

The press-molded product 10 according to the first and second embodiments is molded by performing press working twice on the blank 70, as described using FIG. 2. In contrast, the press-molded product 30 according to the third embodiment is molded by performing press working once (a molding step S22 illustrated in FIG. 23), as illustrated in FIG. 23. That is, the press-molded product 30 is molded directly, not through the primary molded product 80 as illustrated in FIG. 2, from the blank 70, which is a flat plate, prepared in a preparation step S21. This reduces the number of manufacturing steps for manufacturing the press-molded product 30, and improves productivity.

The press-molded product 30 includes an upper wall portion 32, vertical wall portions 33, and flange portions 34. The vertical wall portion 33 and the upper wall portion 32 are made to form an obtuse angle in order to make it easy to mold the press-molded product 30 through the one-time press working. In other words, the press-molded product 30 has a hat-shaped cross-section opening toward lower ends of the vertical wall portions 33. While the upper wall portion 32 and the flange portion 34 have the thickness t1, which is the same as the plate thickness of the blank 70, the vertical wall portion 33 is thickened to the thickness t2. A corner portion 35 between the upper wall portion 32 and the vertical wall portion 33, and a corner portion 36 of the vertical wall portion 33 and the flange portion 34 are also thickened.

3-2. Configuration Example of Press-Molding Apparatus

A configuration example of a press-molding apparatus 300 according to the third embodiment will be described referring to FIGS. 24 to 27. The press-molding apparatus 300 performs press working on the blank 70 to mold the press-molded product 30 in which the vertical wall portions 33 have been thickened.

Figure 24:
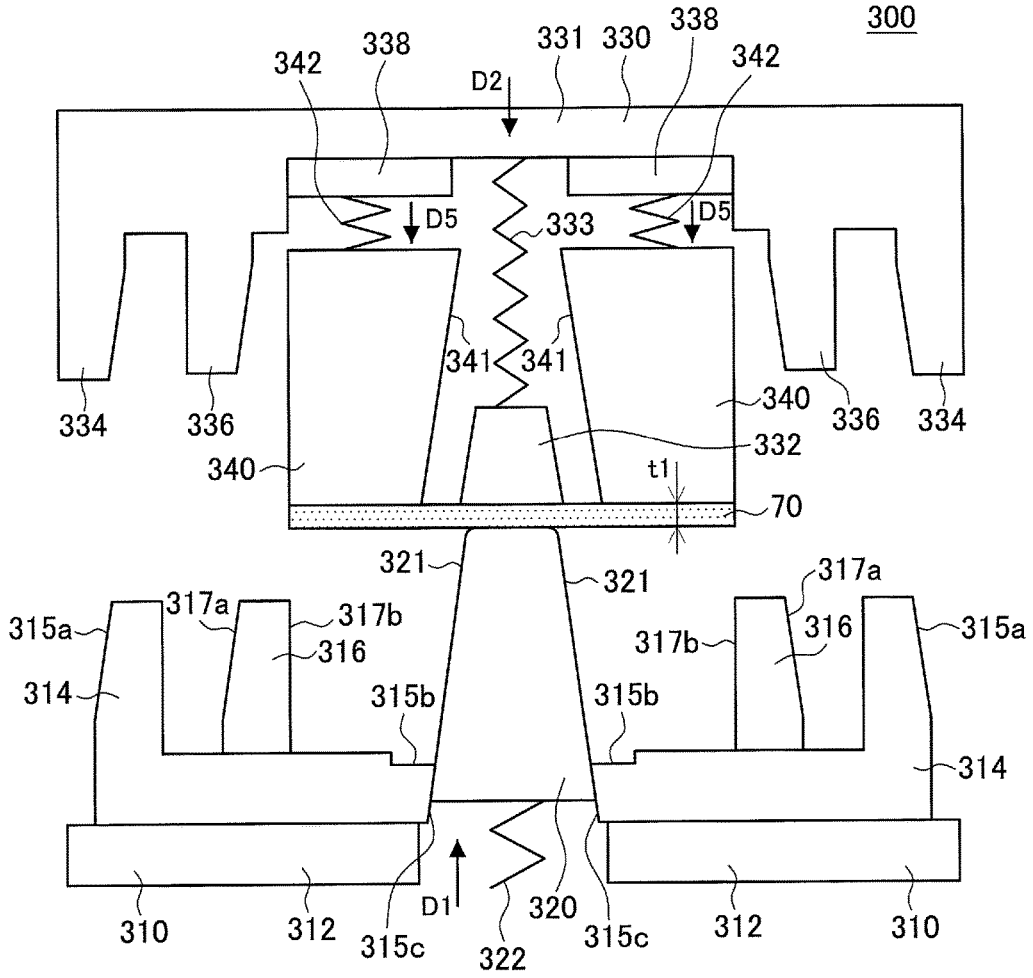
FIG. 24 is a schematic view for explaining a configuration example of a press-molding apparatus according to the third embodiment.
Figure 25:
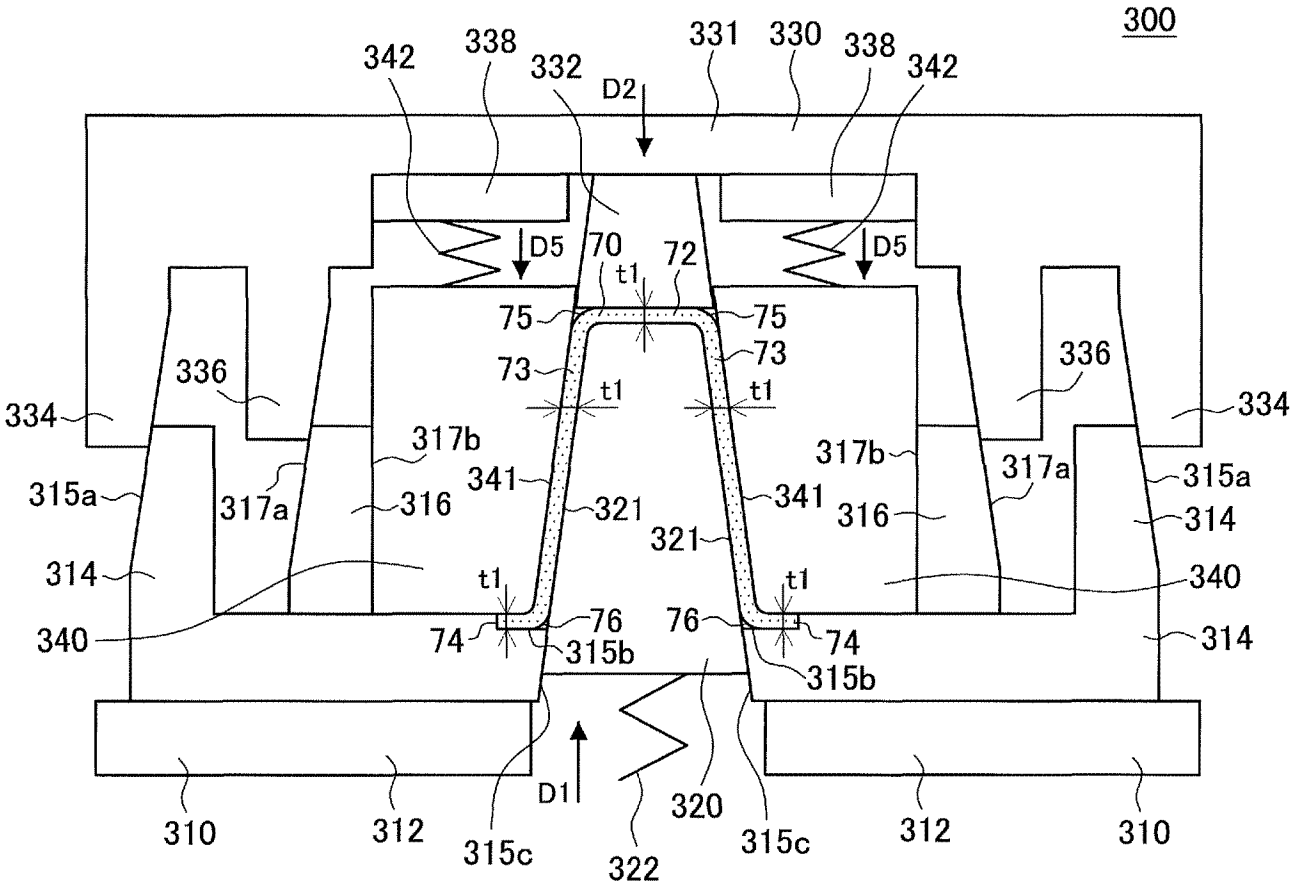
FIG. 25 is a schematic view for explaining the configuration example of the press-molding apparatus according to the third embodiment.
Figure 26:
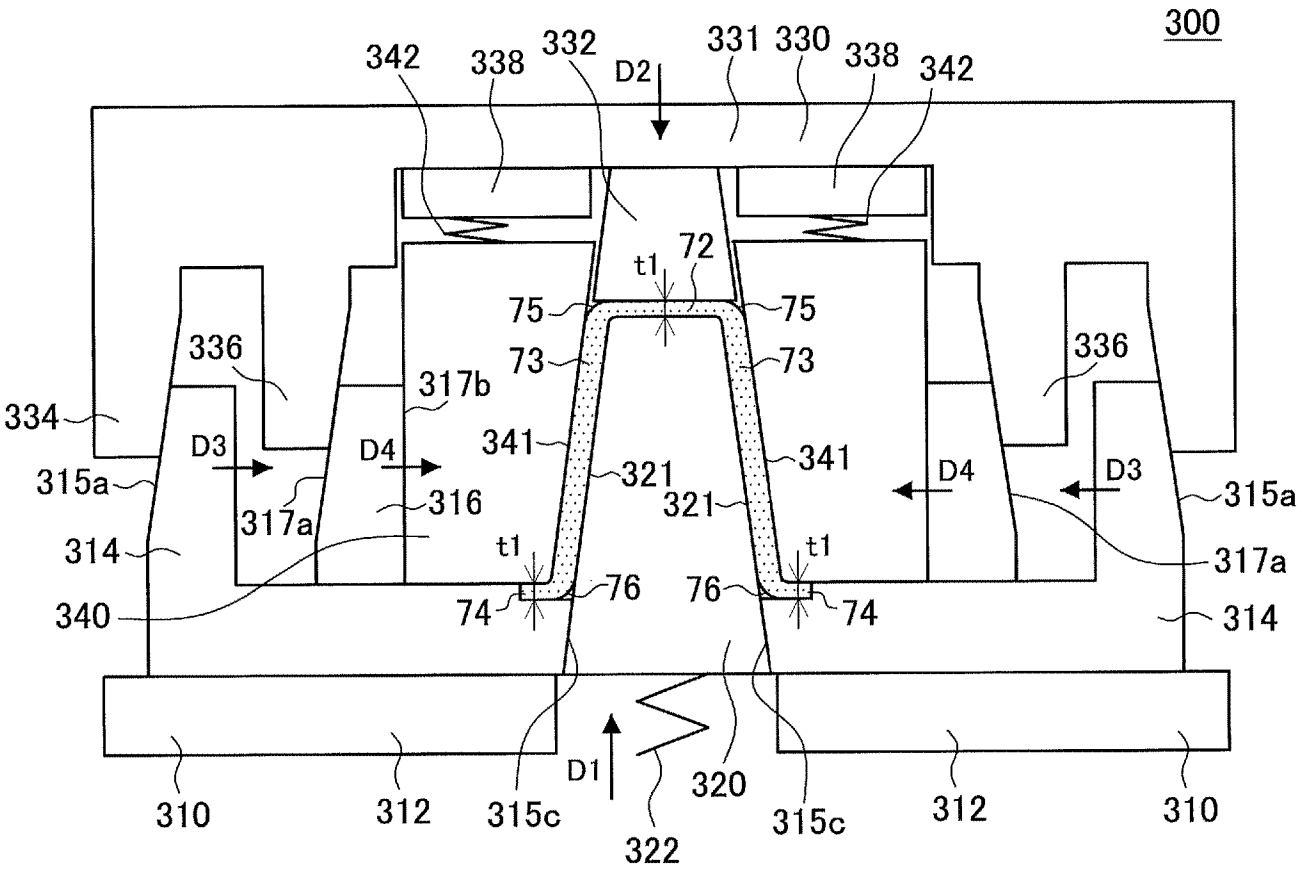
FIG. 26 is a schematic view for explaining the configuration example of the press-molding apparatus according to the third embodiment.
Figure 27:
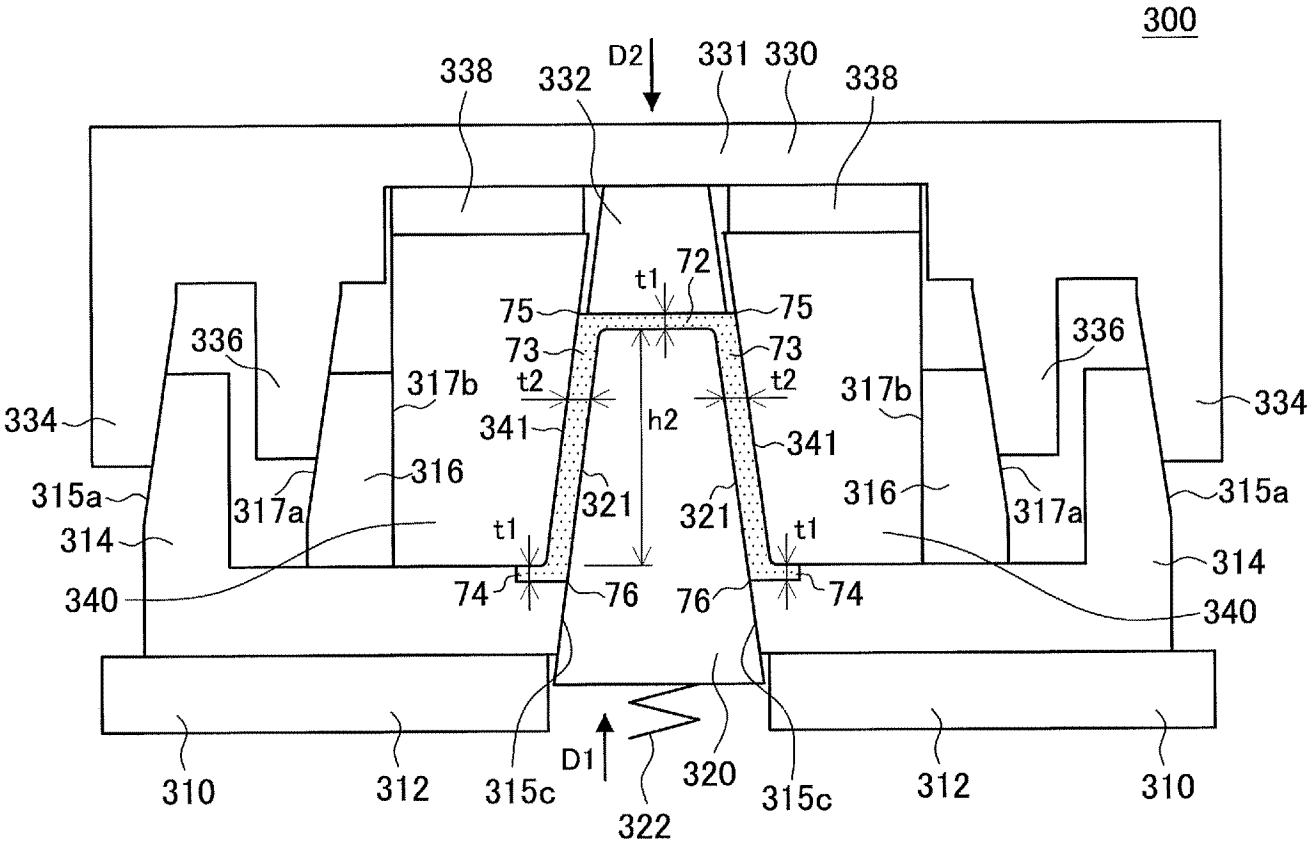
FIG. 27 is a schematic view for explaining the configuration example of the press-molding apparatus according to the third embodiment.

FIGS. 24 to 27 are schematic views for explaining the configuration example of the press-molding apparatus 300 according to the third embodiment. Note that FIG. 24 illustrates a state of the press-molding apparatus 300 just before starting press working, FIGS. 25 and 26 illustrate a state of the press-molding apparatus 300 during the press working, and FIG. 27 illustrates a state of the press-molding apparatus 300 at the end of the press working (a punch is positioned at the bottom dead point).

Note that in the present embodiment, it can be said that in addition to press working like that performed in the above first and second embodiments, that is, press working for thickening the vertical wall portions 83 of the primary molded product 80, additional press working for bending a flat plate 70 to mold an intermediate work with a shape corresponding to the primary molded product 80 is performed before the press working for thickening by the press-molding apparatus 300.

The press-molding apparatus 300 includes, as illustrated in FIGS. 24 to 27, a die 310, a cushion 320, a punch 330, and pads 340.

The die 310 is supported by a lower holder (not illustrated) of the press-molding apparatus 300. The die 310 includes a fixed portion 312, first movable portions 314, and second movable portions 316. The fixed portion 312 is a plate fixed to the lower holder.

The first movable portion 314 is movably provided on the fixed portion 312. The first movable portion 314 has a first surface to be pressed 315*a* to be pressed by a first pressing portion 334 of the punch 330. When the first surface to be pressed 315*a* is pressed by the first pressing portion 334, the first movable portion 314 moves in a direction approaching the cushion 320. In addition, the first movable portion 314 is provided with a flange-supporting recessed portion 315*b* that supports an area corresponding to the flange portion 34 of the press-molded product 30. Furthermore, the cushion 320 side of the first movable portion 314 is provided with a first contact surface 315*c* to be in contact with a tapered surface 321 of the cushion 320. The first contact surface 315*c* is an inclined surface parallel to the tapered surface 321.

The second movable portion 316 is movably provided on the first movable portion 314. The second movable portion 316 has a second surface to be pressed 317*a* to be pressed by a second pressing portion 336 of the punch 330. The second surface to be pressed 317*a* is positioned closer to the cushion 320 than the first surface to be pressed 315*a* is. When the second surface to be pressed 317*a* is pressed by the second pressing portion 336, the second movable portion 316 moves in a direction approaching the cushion 320. In addition, the side of the second movable portion 316 opposite to the second surface to be pressed 317*a* is provided with a second contact surface 317*b* to be in contact with the pad 340.

The cushion 320 is movably supported by the lower holder of the press-molding apparatus 300. The cushion 320 supports the set blank 70 from the lower side. At side surfaces of the cushion 320, the tapered surfaces 321 are formed such that the width of the cushion 320 gets smaller from the bottom toward the top. The cushion 320 is biased in the direction D1 by a biasing member 322, such as a spring. In addition, the cushion 320 is placed between the second contact surfaces 317*b* of the second movable portions 316 positioned on both sides.

The punch 330 is movably supported by an upper holder (not illustrated) of the press-molding apparatus 300. The punch 330 is positioned above the blank 70, and moves downward in the direction D2 (the opposite direction to the direction D1) at the time of press working. Through the press working, the punch 330 bends the blank 70, which is a flat plate, into a hat-shaped cross-section, and thickens areas corresponding to the vertical wall portions 33 of the press-molded product 30. The punch 330 includes a sandwiching portion 332, the first pressing portions 334, the second pressing portions 336, and link portions 338.

The sandwiching portion 332 is positioned above the set blank 70, and sandwiches the blank 70 between the sandwiching portion 332 and the cushion 320. The sandwiching portion 332 is biased in the direction D2 by a biasing member 333.

The first pressing portion 334 is provided at a position corresponding to the first movable portion 314 of the die 310. The first pressing portion 334 presses the first surface to be pressed 315*a* of the first movable portion 314 when the punch 330 moves downward. This causes the first movable portion 314 to move in the direction D3 as illustrated in FIG. 26. In addition, in accordance with the movement of the first movable portion 314 in the direction D3, the first contact surface 315*c* of the first movable portion 314 maintains its contact with the cushion 320 that moves downward. Note that the amount of movement of the first movable portion 314 in the direction D3 increases as the punch 330 moves downward.

The second pressing portion 336 is provided at a position corresponding to the second movable portion 316 of the die 310. The second pressing portion 336 presses the second surface to be pressed 317*a* of the second movable portion 316 when the punch 330 moves downward. This causes the second movable portion 316 to move in the direction D4 as illustrated in FIG. 26. In addition, as the second movable portion 316 moves in the direction D4, the pad 340 in contact with the second contact surface 317*b* of the second movable portion 316 also moves in the direction D4.

The link portion 338 is linked to a biasing member 342 that biases the pad 340. The link portion 338 is attached to a main body portion 331 of the punch 330 to be able to move in the lateral direction together with the pad 340. Note that the amount of movement of the link portion 338 (the pad 340) is the same as the amount of movement of the second movable portion 316, but smaller than the amount of movement of the first movable portion 314.

The pads 340 are positioned on both sides of the sandwiching portion 332 of the punch 330, and are in contact with the upper surface of the blank 70. The pads 340 have a function of a punch that bends the blank 70 into a hat-shaped cross-section as illustrated in FIG. 25 during the press working. As a result, an upper wall area 72 corresponding to the upper wall portion 32 of the press-molded product 30, vertical wall areas 73 corresponding to the vertical wall portions 33, and flange areas 74 corresponding to the flange portions 34 are formed. The pad 340 faces the cushion 320 with the vertical wall area 73 placed therebetween, as illustrated in FIGS. 25 to 27. A counter surface 341 of the pad 340 that faces the cushion 320 forms an inclined surface (second inclined surface) parallel to the tapered surface 321 (first inclined surface that faces the vertical wall portion) of the cushion 320.

In addition, the pad 340 is biased in the direction D5 by the biasing member 342, such as a spring. One end portion of the biasing member 342 is linked to the pad 340, and the other end portion thereof is linked to the link portion 338 of the punch 330. When the second movable portion 316 in contact with the pad 340 moves in the direction D4, the pad 340 is pressed by the second contact surface 317*b* to move in the direction D4 together with the link portion 338. Then, when the punch 330 is positioned at the bottom dead point as illustrated in FIG. 27, the distance between the pad 340 and the cushion 320 becomes the same as the thickness t2 of the vertical wall portion 33. Thus, the vertical wall area 73 is thickened from the thickness t1 to the thickness t2. At this time, corner areas 75 and 76 are also thickened. Note that the vertical wall area 73 is thickened while strain is caused, thus being hardened.

3-3. Operation Example of Press-Molding Apparatus

Next, an operation example of the press-molding apparatus 300 will be described referring to FIGS. 24 to 27.

In this operation example, the punch 330 starts to move downward from a state illustrated in FIG. 24. Accordingly, the pads 340 also start to move downward. At this time, the blank 70 sandwiched by the sandwiching portion 332 and the cushion 320 is pressed by the pads 340 to be bent into a hat-shaped cross-section as illustrated in FIG. 25 (at this time, the cushion 320 does not move downward, in other words, the pads 340 abutting on the blank 70 move downward relative to the cushion 320, the die 310, and the sandwiching portion 332 of the punch 330). At this stage of the press working (the stage referred to as additional press working in the above description), the upper wall area 72, the vertical wall areas 73, and the flange areas 74 are formed in the blank 70. At this time, the flange area 74 including a lower end portion of the vertical wall area 73 abuts against the flange-supporting recessed portion 315*b* of the die 310. In addition, the vertical wall area 73 is placed between the cushion 320 and the pad 340.

After that, when the punch 330 further moves downward, the cushion 320 is also pressed by the sandwiching portion 332 to move downward. This causes the vertical wall area 73 to shrink. In addition, in conjugation with the downward movement of the punch 330, the first pressing portion 334 presses the first surface to be pressed 315*a* of the first movable portion 314. Thus, as illustrated in FIG. 26, the first movable portion 314 moves in the direction D3 and a contact state between the first contact surface 315*c* and the cushion 320 that moves downward is maintained.

In addition, in conjugation with the downward movement of the punch 330, the second pressing portions 336 presses the second surface to be pressed 317*a* of the second movable portion 316. Thus, as illustrated in FIG. 26, the second movable portion 316 moves in the direction D4, to cause the pad 340 in contact with the second contact surface 317*b* to move in a direction approaching the cushion 320. Here, the inclination of the second surface to be pressed 317*a* is adjusted such that the distance between the cushion 320 (specifically, the tapered surface 321) and the pad 340 (specifically, the counter surface 341) increases gradually.

More specifically, the tapered surface 321 recedes in a direction going away from the vertical wall area 73 as the cushion 320 moves downward. Meanwhile, the movement of the pad 340 approaching the cushion 320 causes the counter surface 341 to proceed toward the vertical wall area 73, to follow the tapered surface 321 that recedes. The amount by which the counter surface 341 proceeds at this time is smaller than the amount by which the tapered surface 321 recedes. In other words, as the punch 330 and the cushion 320 move downward, the tapered surface 321 and the counter surface 341 both move toward the center side of the cushion 320, but the distance between the tapered surface 321 and the counter surface 341 is enlarged gradually.

Thus, as the cushion 320 moves downward, the vertical wall area 73 shrinks in the vertical direction (direction D2) and expands in the lateral direction (the opposite direction to the direction D4). At this time, contact between the vertical wall area 73 and the pad 340 is maintained and thus the vertical wall area 73 can be prevented from warping and buckling.

Then, the cushion 320 and the pad 340 keep moving until the punch 330 reaches the bottom dead point as illustrated in FIG. 27. Then, when the punch 330 reaches the bottom dead point, the distance between the pad 340 and the cushion 320 which have moved becomes the same as the increased thickness t2 of the vertical wall area 73. Thus, the vertical wall area 73 is thickened to the thickness t2. At this time, the corner areas 75 and 76 are also thickened.

Meanwhile, the upper wall area 72 and the flange area 74 of the blank 70 maintain the thickness t1 until the punch 330 reaches the bottom dead point. As a result, when press working is completed, the press-molded product 30 in which the vertical wall portions 33 and the corner portions 35 and 36 have been thickened is produced. The press-molded product 30 produced in this manner also exhibits characteristics similar to those of the aforementioned press-molded product 10 described using FIGS. 7 to 11, and can improve collision performance when used for a center pillar of a car, for example.

In the present embodiment, a driving mechanism that is constituted by the second surface to be pressed 317*a* formed on the second movable portion 316 of the die 310 in contact with the pad 340 and the second pressing portion 336 formed in the punch 330 causes the pad 340 to move in a direction approaching the cushion 320 during the press working; thus, the counter surface 341 of the pad 340 proceeds toward the vertical wall area 73. Meanwhile, as the cushion 320 moves downward, the tapered surface 321 of the cushion 320 recedes in a direction going away from the vertical wall area 73. Adjustment to make the amount by which the counter surface 341 proceeds smaller than the amount by which the tapered surface 321 recedes allows the above driving mechanism to function also as a distance adjustment mechanism that enlarges the distance between the cushion 320 and the pad 340 concurrently with the downward movement of the punch 330 during the press working. It has already been described that such a distance adjustment mechanism makes it possible to maintain contact between the pad 340 and the vertical wall area 73 during the press working, and prevent buckling of the vertical wall area 73.

3-4. Modification

A modification of the third embodiment will be described. Examples of the configuration and operation of a press-molding apparatus 350 according to the modification of the third embodiment will be described below, referring to FIGS. 28 to 31. Note that a press-molded product molded by the press-molding apparatus 350 is the same as the press-molded product 30, except for the absence of the flange portions 34 of the press-molded product 30 illustrated in FIG. 23.

Figure 28:
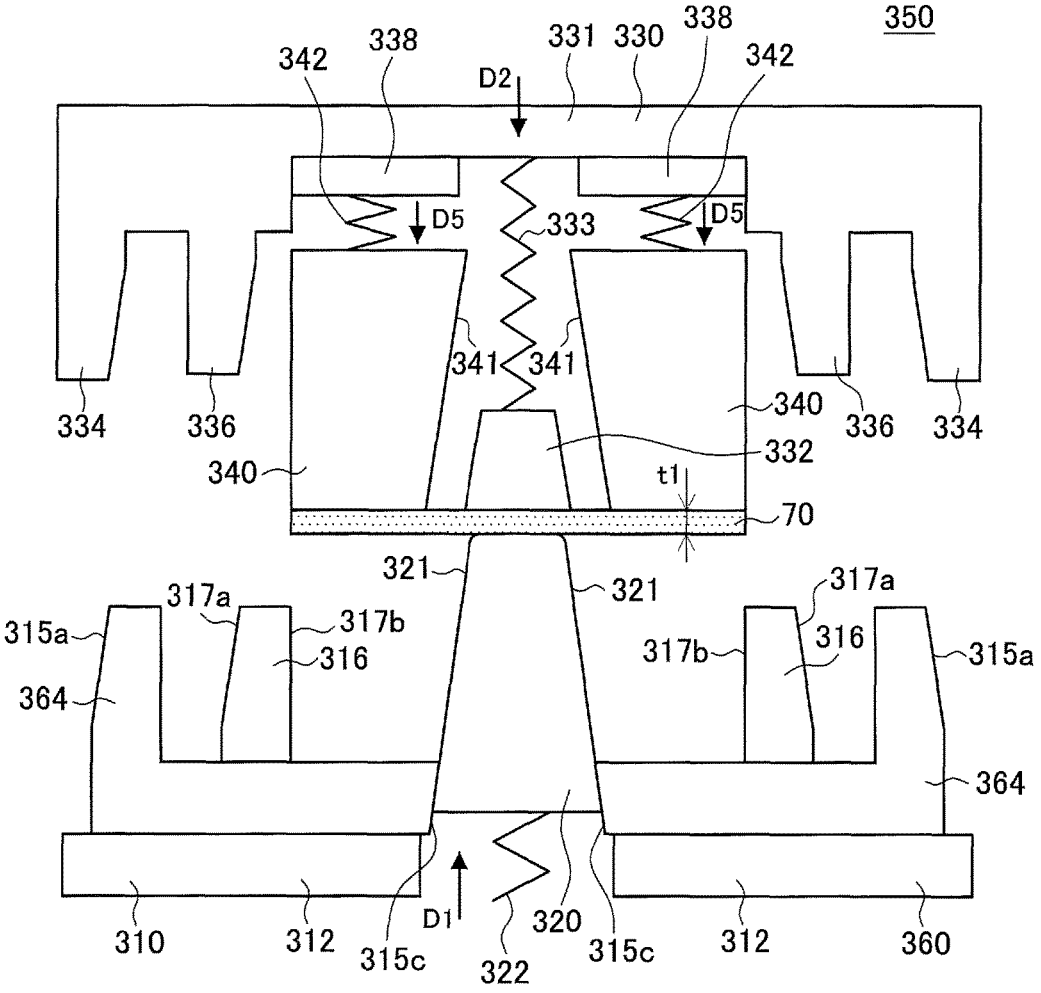
FIG. 28 is a schematic view for explaining a configuration example of a press-molding apparatus according to a modification of the third embodiment.
Figure 29:
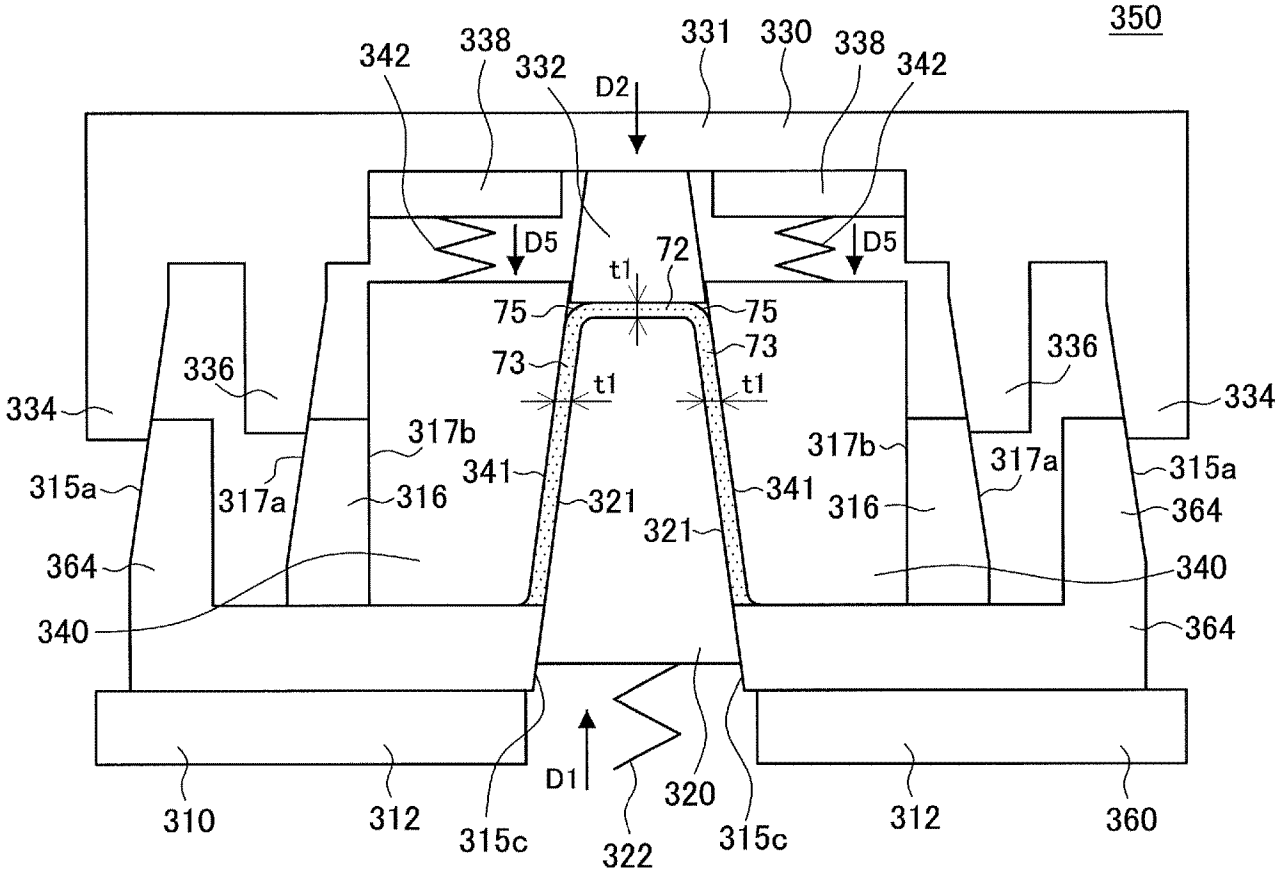
FIG. 29 is a schematic view for explaining the configuration example of the press-molding apparatus according to the modification of the third embodiment.
Figure 30:
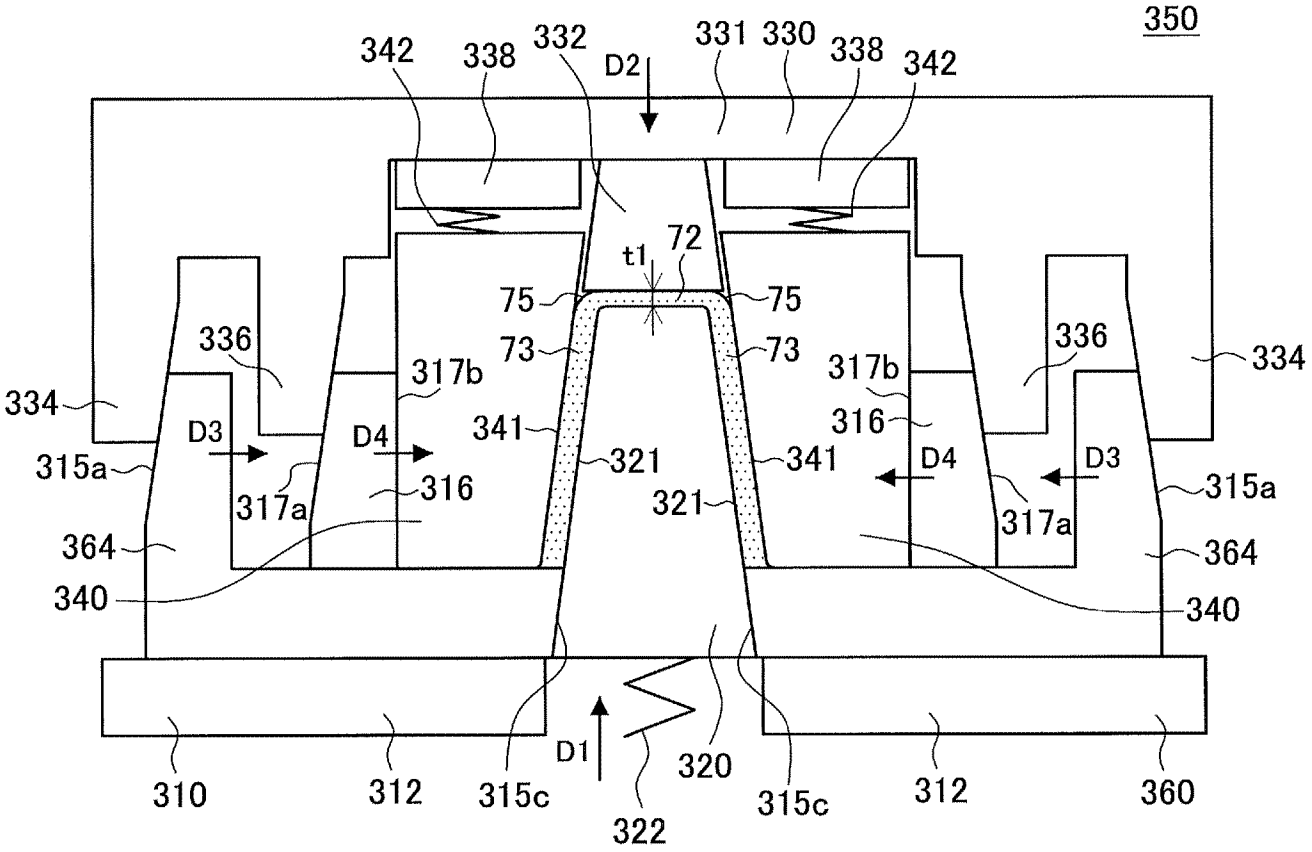
FIG. 30 is a schematic view for explaining the configuration example of the press-molding apparatus according to the modification of the third embodiment.
Figure 31:
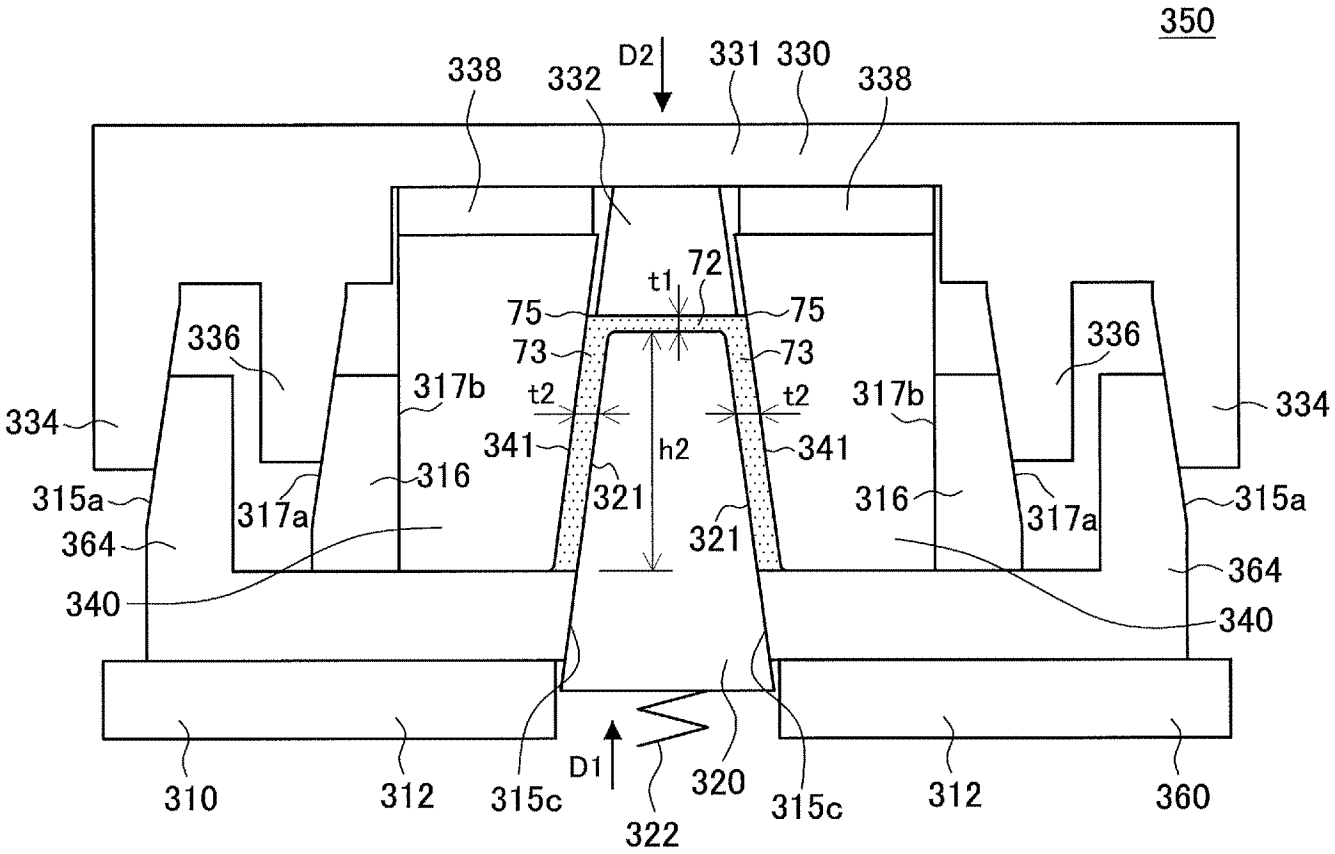
FIG. 31 is a schematic view for explaining the configuration example of the press-molding apparatus according to the modification of the third embodiment.

FIGS. 28 to 31 are schematic views for explaining the configuration example of the press-molding apparatus 350 according to the modification of the third embodiment. Note that FIG. 28 illustrates a state of the press-molding apparatus 350 just before starting press working, FIGS. 29 and 30 illustrate a state of the press-molding apparatus 350 during the press working, and FIG. 31 illustrates a state of the press-molding apparatus 350 at the end of the press working (a punch is positioned at the bottom dead point).

The press-molding apparatus 350 includes, as illustrated in FIGS. 28 to 31, a die 360, the cushion 320, the punch 330, and the pads 340.

The die 360 according to the modification has the same configuration as the die 310 of the press-molding apparatus 300 illustrated in FIGS. 24 to 27, except that first movable portions 364 are not provided with the flange-supporting recessed portions 315*b*. In addition, configurations of the cushion 320, the punch 330, and the pads 340 of the press-molding apparatus 350 are the same as those of the press-molding apparatus 300. Therefore, the main functions of the die 360, the cushion 320, the punch 330, and the pads 340 of the press-molding apparatus 350 are similar to those of the press-molding apparatus 300.

Next, the operation example at the time of press working of the press-molding apparatus 350 will be described.

In this operation example, the punch 330 starts to move downward from a state illustrated in FIG. 28. Accordingly, the pads 340 also start to move downward. At this time, the blank 70 sandwiched by the sandwiching portion 332 and the cushion 320 is pressed by the pads 340 to be bent into a hat-shaped cross-section as illustrated in FIG. 29 (at this time, the cushion 320 does not move downward, in other words, the pads 340 abutting on the blank 70 move downward relative to the cushion 320, the die 360, and the sandwiching portion 332 of the punch 330). At this stage of the press working, the upper wall area 72, the vertical wall areas 73, and the flange areas 74 are formed in the blank 70. At this time, a lower end portion of the vertical wall area 73 abuts against the first movable portion 364 of the die 360. In addition, the vertical wall area 73 is placed between the cushion 320 and the pad 340.

After that, when the punch 330 further moves downward, the cushion 320 is also pressed by the sandwiching portion 332 to move downward. This causes the vertical wall area 73 to shrink. In addition, in conjugation with the downward movement of the punch 330, the first pressing portion 334 presses the first surface to be pressed 315*a* of the first movable portion 314, and the second pressing portions 336 presses the second surface to be pressed 317*a* of the second movable portion 316. Thus, as illustrated in FIG. 30, the first movable portion 314 moves in the direction D3 and a contact state between the first contact surface 315*c* and the cushion 320 that moves downward is maintained. In addition, the second movable portion 316 moves in the direction D4, to cause the pad 340 in contact with the second contact surface 317*b* to move in a direction approaching the cushion 320. Here, the inclination of the second surface to be pressed 317*a* is adjusted such that the distance between the cushion 320 and the pad 340 increases gradually. Thus, as the cushion 320 moves downward, the vertical wall area 73 shrinks in the vertical direction (direction D2) and expands in the lateral direction (the opposite direction to the direction D4). At this time, contact between the vertical wall area 73 and the pad 340 is maintained and thus the vertical wall area 73 can be prevented from warping and buckling.

Then, the cushion 320 and the pad 340 keep moving until the punch 330 reaches the bottom dead point as illustrated in FIG. 31. Then, when the punch 330 reaches the bottom dead point, the distance between the pad 340 and the cushion 320 which have moved becomes the same as the increased thickness t2 of the vertical wall area 73. Thus, the vertical wall area 73 is thickened to the thickness t2. At this time, the corner area 75 is also thickened.

Meanwhile, the upper wall area 72 and the flange area 74 of the blank 70 maintain the thickness t1 until the punch 330 reaches the bottom dead point. As a result, when press working is completed, a press-molded product in which the vertical wall portions 33 and the corner portions 35 have been thickened is produced.

Note that in the above description, examples have been described in which the press-molded product 10, 20, 30 has a hat-shaped cross-section or U-shaped cross-section including the flat upper wall portion 12, 22, 32. However, the cross-sectional shape of a press-molded product is not limited to these examples, and may be, for example, a hat-shaped cross-section or U-shaped cross-section in which an upper wall portion has curvature as illustrated in FIG. 32.

Figure 32:
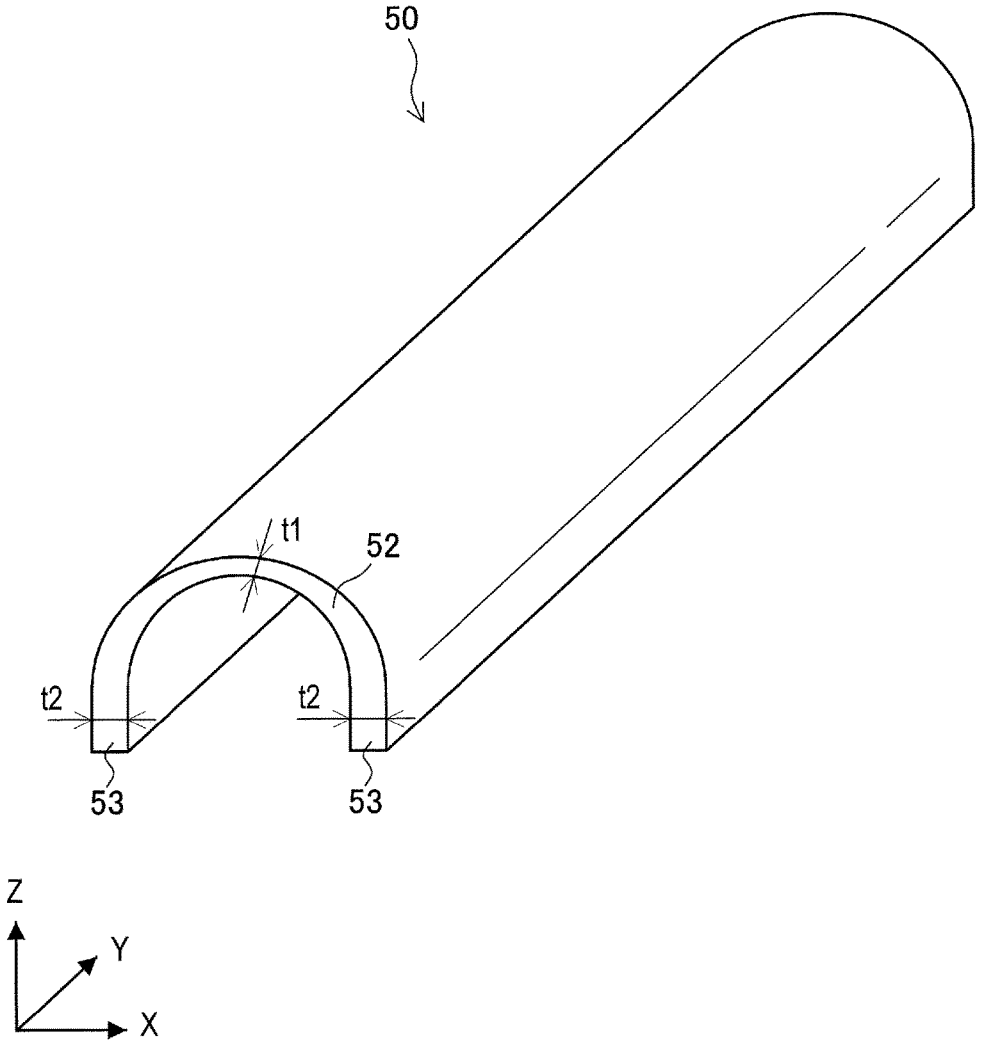
FIG. 32 is a perspective view of a configuration example of a press-molded product according to another embodiment.

FIG. 32 is a perspective view of a configuration example of a press-molded product 50 according to another embodiment. The press-molded product 50 is a long molded product extending with a U-shaped cross-section. The press-molded product 50 includes an upper wall portion 52 with curvature and vertical wall portions 53. The press-molded product 50 is obtained by performing, by a press-molding apparatus, press working on a primary molded product having a U-shaped cross-section and the plate thickness t1 so as to thicken the vertical wall portions 53 to the plate thickness t2, as in the press-molded products 10 and 20.

In addition, in the above description, examples have been described in which the press-molded product 10, 20, 30 has a linear longitudinal cross-section (a cross-section in a direction orthogonal to the hat-shaped cross-section or U-shaped cross-section). However, the shape of a longitudinal cross-section of a press-molded product is not limited to such examples, and may be, for example, a curved longitudinal cross-section as illustrated in FIGS. 33, 34, and 35.

Figure 33:
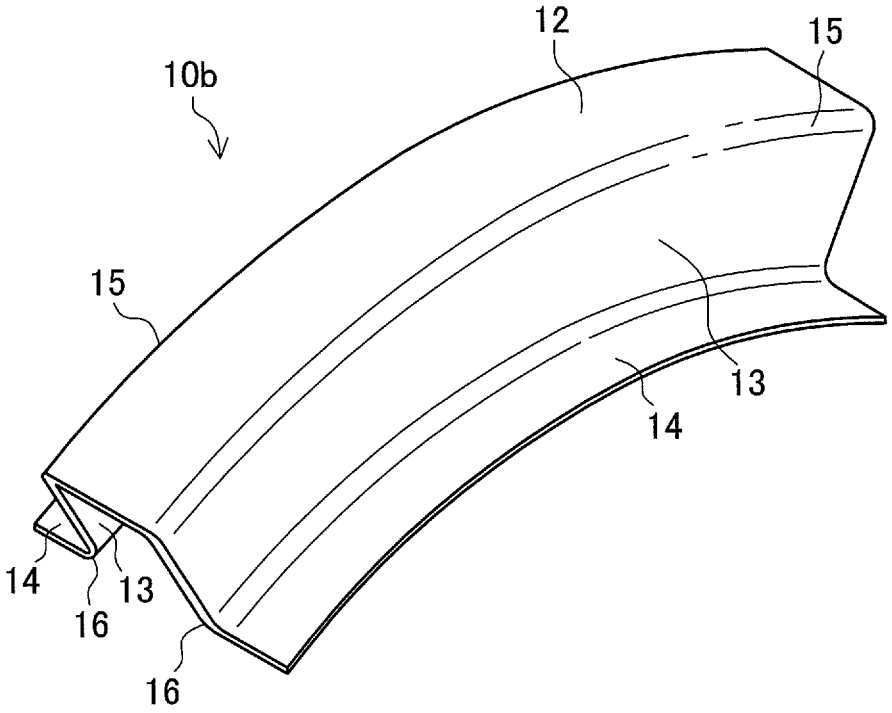
FIG. 33 is a perspective view of a configuration example of a press-molded product according to another embodiment.

FIG. 33 is a perspective view of a configuration example of a press-molded product 10*b* with a hat-shaped cross-section having a longitudinal cross-section curved upward. Also in the press-molded product 10*b*, the vertical wall portion 13 is thickened to the plate thickness t2 with respect to the plate thickness t1 of the portions of the upper wall portion 12 and the flange portion 14, as in the press-molded product 10.

Figure 34:
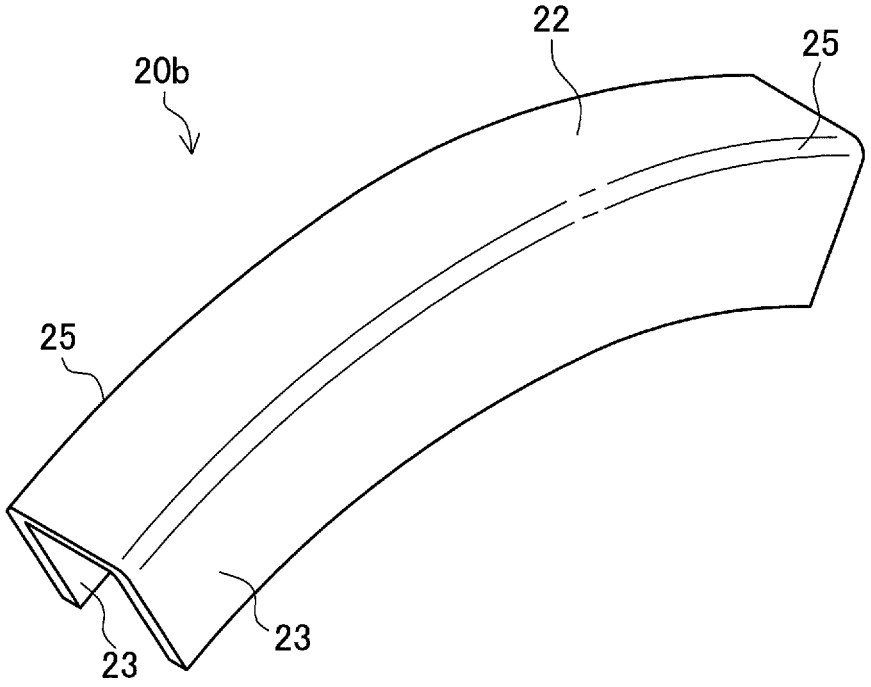
FIG. 34 is a perspective view of a configuration example of a press-molded product according to another embodiment.

FIG. 34 is a perspective view of a configuration example of a press-molded product 20*b* with a U-shaped cross-section having a longitudinal cross-section curved upward. Also in the press-molded product 20*b*, the vertical wall portion 23 is thickened to the plate thickness t2 with respect to the plate thickness t1 of the upper wall portion 22, as in the press-molded product 20.

Figure 35:
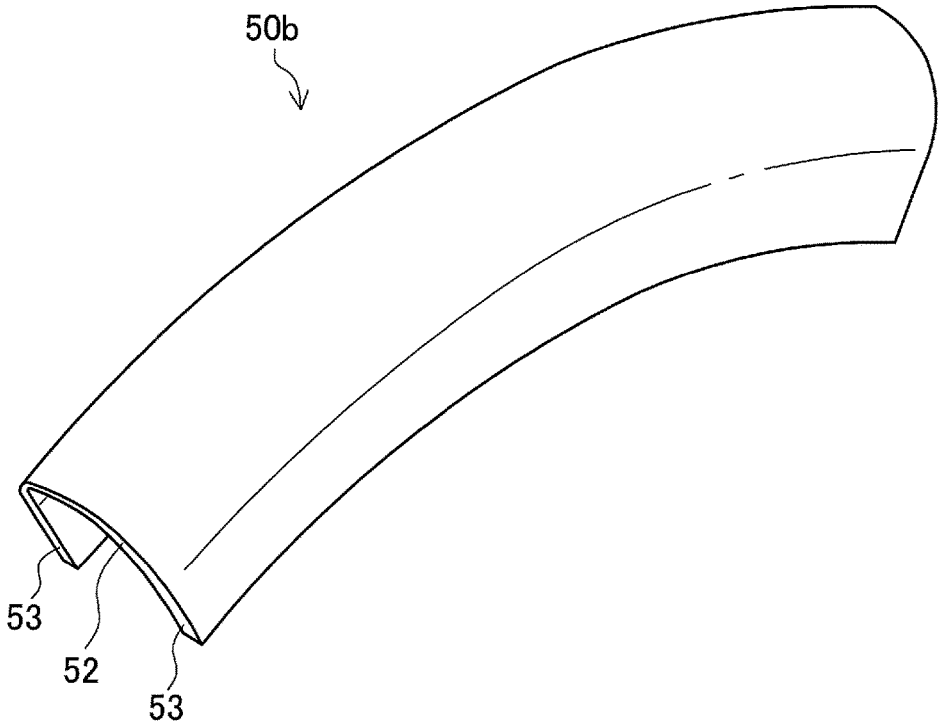
FIG. 35 is a perspective view of a configuration example of a press-molded product according to another embodiment.

FIG. 35 is a perspective view of a configuration example of a press-molded product 50*b* with a U-shaped cross-section having a longitudinal cross-section curved upward and having the upper wall portion 52 with curvature. Also in the press-molded product 50*b*, the vertical wall portion 53 is thickened to the plate thickness t2 with respect to the plate thickness t1 of the upper wall portion 52, as in the press-molded product 50.

In addition, in the above description, examples have been described in which the press-molded product 10, 20, 30 has a linear longitudinal shape. However, the longitudinal shape of a press-molded product is not limited to these examples, and may be, for example, a curved longitudinal shape as illustrated in FIGS. 36 and 37.

Figure 36:
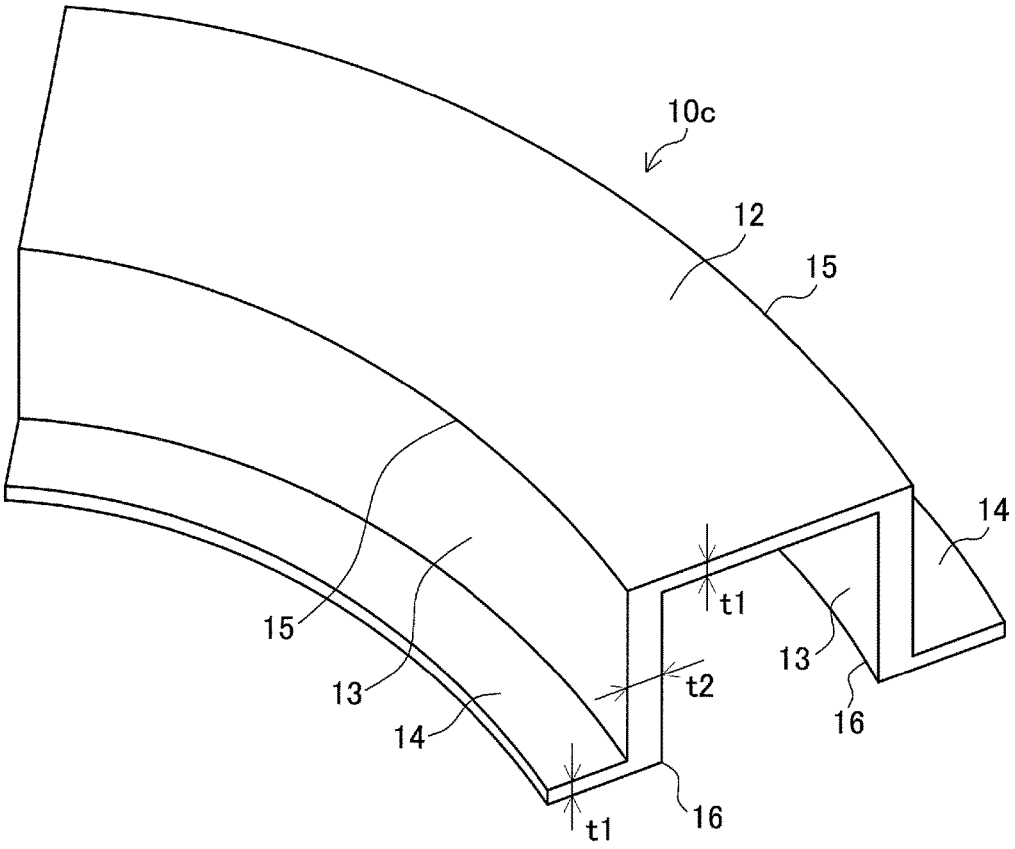
FIG. 36 is a perspective view of a configuration example of a press-molded product according to another embodiment.

FIG. 36 is a perspective view of a configuration example of a press-molded product 10*c* with a hat-shaped cross-section having a curved longitudinal shape. Also in the press-molded product 10*c*, the vertical wall portion 13 is thickened to the plate thickness t2 with respect to the plate thickness t1 of the portions of the upper wall portion 12 and the flange portion 14, as in the press-molded product 10.

Figure 37:
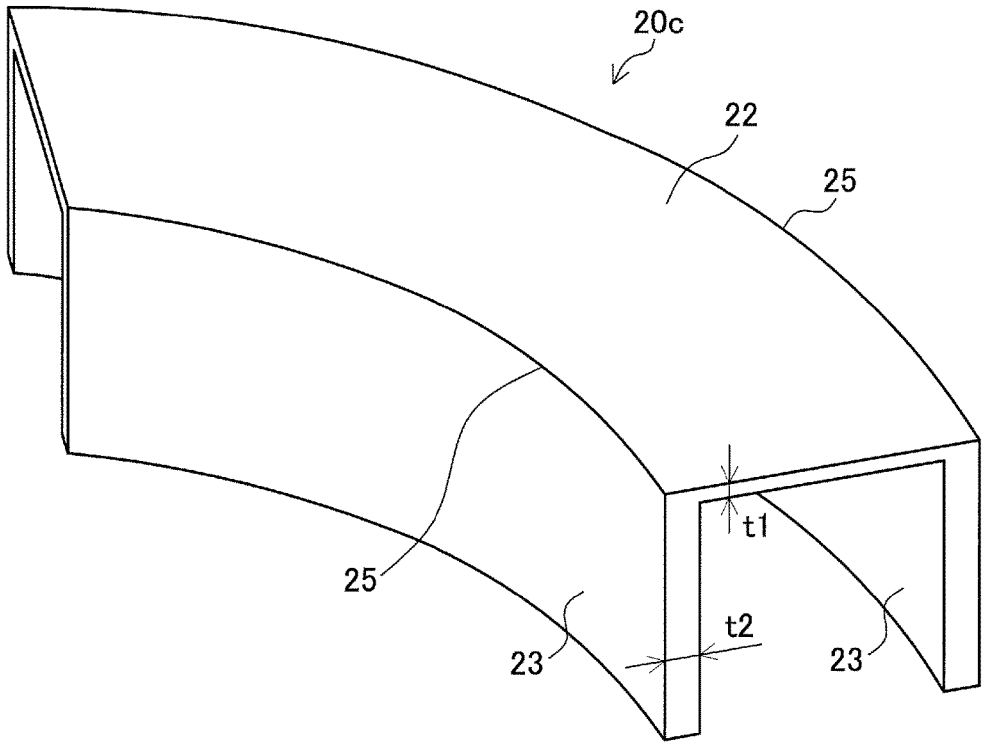
FIG. 37 is a perspective view of a configuration example of a press-molded product according to another embodiment.

FIG. 37 is a perspective view of a configuration example of a press-molded product 20*c* with a U-shaped cross-section having a curved longitudinal shape. Also in the press-molded product 20*c*, the vertical wall portion 23 is thickened to the plate thickness t2 with respect to the plate thickness t1 of the upper wall portion 22, as in the press-molded product 20.

3. Conclusion

In each embodiment described above, the punch 130, 230, 330 moves downward relative to the second support member (the die 110, 210, 310), together with the first support member (the cushion 120, 220, 320), and thereby executes press working of reducing the height of an area (the vertical wall portion 83 of the primary molded product 80, the vertical wall area 73 of the blank 70) of the work that corresponds to the vertical wall portion 13, 23, 33 of the press-molded product 10, 20, 30, and thickening the above area to the second thickness (thickness t2). The pad 140, 240, 340 that faces the cushion 120, 220, 320 with an area to be thickened placed therebetween is, for example, biased by the biasing member 142 as illustrated in FIGS. 3 to 5, or has its distance to the cushion 120, 320 adjusted by the distance adjustment mechanism (the pressing portion 232 and the inclined surface 241, or the first pressing portion 334, the second pressing portion 336, the first movable portion 314, and the second movable portion 316) as illustrated in FIGS. 17 to 19 and FIGS. 25 to 27, thereby maintaining contact with the area to be thickened during the press working. This can reduce warping of the area to be thickened, and thus can also prevent buckling from occurring in the area to be thickened during the press working. As a result, a predetermined area of the work can be thickened appropriately.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

REFERENCE SIGNS LIST

10, 20, 30 press-molded product
12, 22, 32 upper wall portion
13, 23, 33 vertical wall portion
14, 34 flange portion
15, 16, 25, 35, 36 corner portion
70 blank
72 upper wall area
73 vertical wall area
74 flange area
75, 76 corner area
80 primary molded product
82 upper wall portion
83 vertical wall portion
84 flange portion
85, 86 corner portion
100, 150, 200, 250, 300, 350 press-molding apparatus
110, 160, 210, 260, 310, 360 die
314 first movable portion
316 second movable portion
120, 220, 320 cushion
122 biasing member
320 cushion
321 tapered surface
130, 230, 330 punch
232 pressing portion
233 pressing surface
332 sandwiching portion
334 first pressing portion
336 second pressing portion
140, 240, 340 pad
142, 242 biasing member
341 counter surface

The invention claimed is:

1. A press-molding apparatus configured to mold a press-molded product by performing press working on a work, the work having a hat-shaped cross-section or a U-shaped cross-section including an upper wall portion and a vertical wall portion extending downward from the upper wall portion with a first thickness and having a bottom edge, the press-molding apparatus comprising:

a first support member that supports the work from the inside of the hat-shaped cross-section or the U-shaped cross-section;

a second support member that supports the work at a lower end portion of the vertical wall portion;

a punch member spaced from the first support member in a first direction and movable in the first direction relative to the second support member, together with the first support member, to execute press working of reducing a height of the vertical wall portion and thickening the vertical wall portion to a second thickness larger than the first thickness;

a pad member spaced from the first support member in a second direction perpendicular to the first direction with the vertical wall portion placed between the pad member and the first support member, the pad member movable in the second direction; and a position adjustment mechanism that adjusts a position of the pad member in the second direction in a manner that contact between the pad member and the vertical wall portion is maintained during the press working.

2. The press-molding apparatus according to claim 1, wherein the position adjustment mechanism includes a biasing member that biases the pad member toward the vertical wall portion.

3. The press-molding apparatus according to claim 1, wherein the position adjustment mechanism includes a distance adjustment mechanism that enlarges a distance between the first support member and the pad member concurrently with downward movement of the punch member during the press working.

4. The press-molding apparatus according to claim 1, wherein the work has a corner portion connected to the vertical wall portion, and the punch member performs press working so as to reduce a height of the vertical wall portion and thicken the vertical wall portion and the corner portion.

5. The press-molding apparatus according to claim 1, wherein the work is a long member, and the punch member reduces a height of the vertical wall portion in the entire longitudinal direction and thickens the entire vertical wall portion to the second thickness.

6. A press-molding method using the press-molding apparatus according to claim 1, configured to mold a press-molded product by performing press working on a work, the work having a hat-shaped cross-section or a U-shaped cross-section including an upper wall portion and a vertical wall portion with a first thickness, the press-molding method comprising:

a step of causing a first support member to support the work from the inside of the hat-shaped cross-section or the U-shaped cross-section;

a step of causing a second support member to support the work at a lower end portion of the vertical wall portion;

a step of causing a punch member to move downward relative to the second support member, together with the first support member, to execute press working of reducing a height of the vertical wall portion placed between the first support member and a pad member and thickening the vertical wall portion to a second thickness larger than the first thickness; and a step of adjusting a position of the pad member, by a position adjustment mechanism, in a manner that the pad member that faces the first support member with the vertical wall portion placed between the pad member and the first support member maintains contact with the vertical wall portion during the press working.

7. The press-molding apparatus according to claim 1, wherein a width of the punch member is equal to a width of the upper wall portion.

8. The press-molding apparatus according to claim 1, wherein the pad member has a bottom surface contacting a top surface of the second support member.

9. The press-molding apparatus according to claim 8, wherein the pad member has a top surface above a bottom surface of the punch member.

10. The press-molding apparatus according to claim 1, wherein the pad member is movable independent of the second support member.

11. The press-molding apparatus according to claim 1, further comprising:

an opening in the second support member; and a groove in a top surface of the second support member around the opening.

12. The press-molding apparatus according to claim 11, wherein the first support member extends through the opening in the second support member.

13. The press-molding apparatus according to claim 1, wherein the first support member and the punch member are coaxial.

14. A press-molding apparatus configured to mold a press-molded product by performing press working on a work, the work having a hat-shaped cross-section or a U-shaped cross-section including an upper wall portion and a vertical wall portion with a first thickness, the press-molding apparatus comprising:

a first support member that supports the work from the inside of the hat-shaped cross-section or the U-shaped cross-section;

a second support member that supports the work at a lower end portion of the vertical wall portion;

a punch member that moves downward relative to the second support member, together with the first support member, to execute press working of reducing a height of the vertical wall portion and thickening the vertical wall portion to a second thickness larger than the first thickness;

a pad member that faces the first support member with the vertical wall portion placed between the pad member and the first support member; and a position adjustment mechanism that adjusts a position of the pad member in a manner that contact between the pad member and the vertical wall portion is maintained during the press working, wherein the position adjustment mechanism includes a distance adjustment mechanism that enlarges a distance between the first support member and the pad member concurrently with downward movement of the punch member during the press working, and wherein the distance adjustment mechanism includes an inclined surface that is formed on the pad member and is higher at positions farther from the first support member, and a pressing portion that is formed in the punch member and presses the inclined surface to cause the pad member to move in a direction going away from the first support member during the press working.

15. A press-molding apparatus configured to mold a press-molded product by performing press working on a work, the work having a hat-shaped cross-section or a U-shaped cross-section including an upper wall portion and a vertical wall portion with a first thickness, the press-molding apparatus comprising:

a first support member that supports the work from the inside of the hat-shaped cross-section or the U-shaped cross-section;

a second support member that supports the work at a lower end portion of the vertical wall portion;

a punch member that moves downward relative to the second support member, together with the first support member, to execute press working of reducing a height of the vertical wall portion and thickening the vertical wall portion to a second thickness larger than the first thickness;

a pad member that faces the first support member with the vertical wall portion placed between the pad member and the first support member; and a position adjustment mechanism that adjusts a position of the pad member in a manner that contact between the pad member and the vertical wall portion is maintained during the press working, wherein the work has the hat-shaped cross-section or the U-shaped cross-section opening toward a lower end of the vertical wall portion, wherein the first support member has a first inclined surface that faces the vertical wall portion, wherein the pad member has a second inclined surface that faces the first inclined surface with the vertical wall portion placed between the second inclined surface and the first inclined surface, and wherein the distance adjustment mechanism includes a driving mechanism that causes the second inclined surface to proceed toward the vertical wall portion to follow the first inclined surface that recedes from the vertical wall portion owing to downward movement of the first support member during the press working.

16. The press-molding apparatus according to claim 15, wherein additional press working of bending a flat plate to mold the work having the hat-shaped cross-section or the U-shaped cross-section is performed, and in the additional press working, in a state where a portion of the flat plate that constitutes the upper wall portion after processing is sandwiched by the first support member and the punch member, the pad member abutting on the flat plate moves downward relative to the first support member, the second support member, and the punch member to bend a portion of the flat plate that constitutes the vertical wall portion after processing, and cause a lower end portion of the portion to abut against the second support member.

* * * * *